US010496037B2

(12) United States Patent
Kim

(10) Patent No.: US 10,496,037 B2
(45) **Date of Patent: *Dec. 3, 2019**

(54) CUSTOMER REPLACEMENT UNIT MEMORY CONTACT UNIT PRESSURED ACCORDING TO MOVEMENT OF TRAY IN AN IMAGE FORMING APPARATUS

(71) Applicant: HP PRINTING KOREA CO., LTD., Suwon-si, Gyeonggi-do (KR)

(72) Inventor: Mintae Kim, Seoul (KR)

(73) Assignee: HP PRINTING KOREA CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/207,994

(22) Filed: Dec. 3, 2018

(65) Prior Publication Data

US 2019/0101863 A1 Apr. 4, 2019

Related U.S. Application Data

(63) Continuation of application No. 15/656,299, filed on Jul. 21, 2017, now Pat. No. 10,180,654.

(30) Foreign Application Priority Data

Nov. 9, 2016 (KR) ..... 10-2016-0148908

(51) Int. Cl.
*G03G 21/18* (2006.01)
*G03G 15/08* (2006.01)

(52) U.S. Cl.
CPC ..... *G03G 21/1842* (2013.01); *G03G 15/0863* (2013.01); *G03G 21/1846* (2013.01);
(Continued)

(58) Field of Classification Search
CPC ..... G03G 21/1842; G03G 21/1871
See application file for complete search history.

(56) References Cited

U.S. PATENT DOCUMENTS 8,660,454 B2 2/2014 Lee et al.
8,792,805 B2 7/2014 Takayama
(Continued)

FOREIGN PATENT DOCUMENTS

JP 2010224117 A 10/2010
JP 4592114 B2 12/2010
(Continued)

*Primary Examiner* — Sandra Brase
(74) *Attorney, Agent, or Firm* — Staas & Halsey LLP

(57) ABSTRACT

An image forming apparatus includes a main body, a tray for a toner cartridge slidably coupled to the main body, a lever hinge-coupled to the tray to rotate, and a link member, hinge-coupled to the lever, to move when the lever is rotated. The lever rotates in a first direction when the tray is pushed into the main body and rotates in a second direction opposite to the first direction when the tray is pulled out from the main body. The link member moves in a third direction when the lever is rotated in the first direction to so that pressure is applied to a customer replacement unit memory (CRUM) contact unit and moves in a fourth direction opposite to the third direction when the lever is rotated in the second direction so that the pressure is released from the CRUM contact unit.

20 Claims, 33 Drawing Sheets

(52) U.S. Cl.
CPC ... *G03G 21/1885* (2013.01); *G03G 2221/166* (2013.01); *G03G 2221/1684* (2013.01); *G03G 2221/1869* (2013.01)

(56) References Cited

U.S. PATENT DOCUMENTS

| | | | | |
|---|---|---|---|---|
| 8,824,914 | B2 | 9/2014 | Jeong et al. | |
| 9,229,421 | B2 | 1/2016 | Choi et al. | |
| 10,180,654 | B2 * | 1/2019 | Kim | G03G 15/0863 |
| 2007/0160386 | A1 | 7/2007 | Kawamura | |
| 2008/0159775 | A1 | 7/2008 | Koishi et al. | |
| 2011/0052253 | A1 | 3/2011 | Nieda | |
| 2012/0039624 | A1 | 2/2012 | Uchida et al. | |
| 2012/0148298 | A1 | 6/2012 | Jeong et al. | |
| 2013/0022367 | A1 | 1/2013 | Choi et al. | |
| 2016/0259294 | A1 | 9/2016 | Sakamoto et al. | |

FOREIGN PATENT DOCUMENTS

| | | | |
|---|---|---|---|
| JP | 2015069095 | A | 4/2015 |
| KR | 1020120064766 | A | 6/2012 |
| KR | 1020130011251 | A | 1/2013 |
| KR | 1020120064374 | A | 6/2016 |

* cited by examiner

CUSTOMER REPLACEMENT UNIT MEMORY CONTACT UNIT PRESSURED ACCORDING TO MOVEMENT OF TRAY IN AN IMAGE FORMING APPARATUS

CROSS-REFERENCE TO RELATED APPLICATIONS

This application is a continuation of U.S. patent application Ser. No. 15/656,299, filed on Jul. 21, 2017, which claims priority from Korean Patent Application No. 10-2016-0148908, filed on Nov. 9, 2016, in the Korean Intellectual Property Office, the disclosures of each of which are incorporated herein by reference in their entirety.

BACKGROUND

The following description relates to an image forming apparatus, and more particularly, to an image forming apparatus which disperses a load concentrated on a cover in a cover opening/closing operation by interlocking a portion of a plurality of operations interlocked to the cover opening/closing operation with a push-in/pull-out operation of a tray for a toner cartridge.

Replaceable toner cartridges have been used in image forming apparatuses. Trays on which a plurality of toner cartridges are separately mounted may be provided in inner sides of main bodies of the image forming apparatuses to replace the toner cartridges. The trays may be installed to be pushed into/pulled out from the main bodies. Image transfer belt units may be disposed below the trays in the inner sides of the main bodies of the image display apparatuses.

Openings which the trays are pushed into/pulled out from the main bodies therethrough may be formed in the main bodies of the image forming apparatuses.

DETAILED DESCRIPTION

Figure 1A:
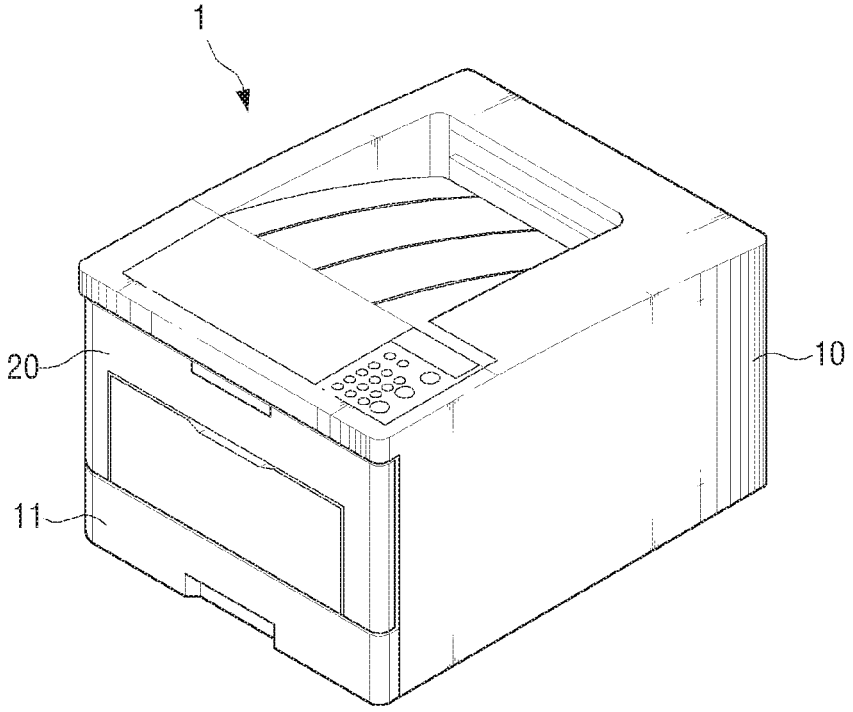
FIG. 1A is a perspective view illustrating an image forming apparatus according to an example.

Hereinafter, example of the disclosure will be described more fully with reference to the accompanying drawings, in which the examples of the disclosure are shown to understand a configuration and an effect of the disclosure. This disclosure may, however, be embodied and modified in many different forms and should not be construed as limited to the examples set forth herein. Rather, these examples are provided so that this disclosure will be thorough and complete, and will fully convey the scope of the disclosure to those skilled in the art. In the drawings, sizes of elements may be enlarged and a ratio between the elements may be exaggerated or reduced for clarity.

It will be understood that, although the terms first, second, etc. may be used herein in reference to elements of the disclosure regardless of an order and/or importance, such elements should not be construed as limited by these terms. The terms are used only to distinguish one element from other elements. For example, without departing from the spirit of the inventive concept, a first element may refer to a second element, and similarly, the second element may refer to the first element.

The terminology used herein is for the purpose of describing particular examples only and is not intended to be limiting of the inventive concept. As used herein, the singular forms "a," "an" and "the" are intended to include the plural forms as well, unless the context clearly indicates otherwise. It will be further understood that the terms "comprises" and/or "includes" when used in this specification, specify the presence of stated features, integers, steps, operations, elements, components, and/or groups thereof, but do not preclude the presence or addition of one or more other features, integers, steps, operations, elements, components, and/or groups thereof.

It will be further understood that the terms used herein should be interpreted as the meaning defined herein. Unless otherwise defined, all terms including technical and scientific terms used herein have the same meaning as commonly understood by one of ordinary skill in the art to which this inventive concept belongs.

Image forming apparatuses may perform various operations in conjunction with a cover opening/closing operation. For example, the image forming apparatuses may perform a contact/separation operation between a photosensitive drum provided in a toner cartridge and an image transfer belt unit through elevation of the tray, an electrical connection/release operation between a contact terminal of a high-voltage power supply unit and a high-voltage terminal provided in a toner cartridge, an electrical connection/release operation between a terminal of a customer replacement unit memory (CRUM) contact unit and a terminal of a CRUM provided in the toner cartridge, and a coupling/separation operation between a driving coupler and the photosensitive drum and one side of a developing roller provided in the toner cartridge, according to the opening/closing operation of the cover.

Such image forming apparatuses may have a complicated structure to perform various operations in conjunction with the opening/closing operation of the cover. The image forming apparatuses may be configured to perform the various operations in conjunction with the opening operation of the cover and thus the large load may be concentrated on a hinge part of the cover hinge-coupled to the main body. Accordingly, the hinge part may be broken and the cover may not be opened easily.

Examples disclosed herein may overcome the above disadvantages and other disadvantages not described above. Also, an example is not required to overcome the disadvantages described above, and an example may not overcome any of the problems described above.

One or more examples relate to an image forming apparatus which disperses a load concentrated on a cover in an opening/closing operation of the cover by interlocking a portion of a plurality of operations interlocked with an opening/closing operation of the cover with a push-in/pull-out operation of a tray for cartridge.

According to an aspect of an example, there is provided an image forming apparatus including a main body; a tray slidably coupled to the main body and configured to receive a toner cartridge and be pushed into the main body by a push-in operation and pulled out from the main body by a pull-out operation; a lever hinge-coupled to the tray and configured to rotate in a first direction and a second direction opposite to the first direction according to the push-in operation of the tray and the pull-out operation of the tray respectively; a support frame configured to elastically support a customer replacement unit memory (CRUM) contact unit; and a link member hinge-coupled to the lever and configured to move in a direction of the push-in operation of the tray and in a direction of the pull-out operation of the tray according to the rotation of the lever to apply and release pressure on the CRUM contact unit supported by the support frame.

The tray may include a push rib configured to apply pressure to a first portion of the lever in the push-in operation of the tray. The tray may further include an auxiliary push rib configured to apply pressure to the first portion of the lever in the pull-out operation of the tray. The auxiliary push rib may be located to be spaced apart from the push rib and may be located closer to the CRUM contact unit than the push rib. The auxiliary push rib may be formed to have an upper end height smaller than that of the push rib so that an upper end of the auxiliary push rib may remain clear of the tray as the tray is moved in the push-in operation of the tray.

The main body further includes a first side frame, and the lever may be hinge-coupled to the first side frame and may be elastically coupled to the first side frame through an elastic member. A first end of the elastic member may be fixed to the lever and a second end of the elastic member may be fixed to the first side frame so that an elastic force may be applied to the lever in the direction of the push-in operation of the tray and the direction of the pull-out operation of the tray. The elastic member may be located in the lever hinge-coupled to the first side frame.

The link member may include at least one cam protrusion configured to apply pressure to at least one guide protrusion which protrudes from the CRUM contact unit and the cam protrusion may include an inclined cam end portion which is in contact with at least one the guide protrusion.

The image forming apparatus may further include a handle rotatably coupled to the tray; and a latch in which the tray is configured to move along an inner side thereof according to rotation of the handle, and including a front-end that selectively protrudes toward an outside of the tray. The front-end of the latch may protrude such that the lever contacts with the front-end. the handle may be in contact with the latch and the front-end of the latch may protrude toward an outer side of the tray in response to the handle being rotated in a first handle rotation direction and may move toward an inner side of the tray in response to the handle being rotated in a second handle rotation direction. The latch may be elastically supported in a protruding direction of the latch by an elastic member.

The image forming apparatus may further include a handle rotatably coupled to the tray; a movable lever located in a side of the tray and configured to rotate with the handle; a first guide member configured to move according to the rotation of the movable lever; and a second guide member fixed to an image transfer unit of the image forming apparatus. The tray may be selectively raised according to the movement of the first guide member. The first guide member may be located to slidably move along a lower end of the tray. The first and second guide members respectively may include first and second guide protrusions which are in contact with each other. The first and second guide protrusions may include inclined portions inclined in directions opposite to each other.

According to an aspect of an example, there is provided an image forming apparatus including a main body; a tray slidably coupled to the main body and configured to receive a toner cartridge be pushed into the main body by a push-in operation and to be pulled out from the main body by a pull-out operation; and an interlocking unit configured to apply and release pressure on a customer replacement unit memory (CRUM) contact unit according to the push-in operation of the tray and the pull-out operation of the tray, respectively. The CRUM contact unit may be lowered by the interlocking unit and may be electrically coupled to the toner cartridge in the push-in operation of the tray and may be raised by an elastic force to release the electrical coupling to the toner cartridge in the pull-out operation of the tray.

Additional aspects and advantages of the examples are set forth in the detailed description, and will be apparent from the detailed description, or may be learned by practicing the examples.

A configuration of an image forming apparatus according to an example will be described with reference to the accompanying drawings. A color laser printer as an example of the image forming apparatus according to an example will be described.

The image forming apparatus according to an example may prevent a load from being concentrated on a cover in cover opening/closing by interlocking at least one of a plurality of operations interlocked to the cover opening/closing with a push-in/pull-out operation of a tray. Here, the push-in operation may refer to an operation that the tray is drawn into the inside of a main body and the pull-out operation may refer to an operation that the tray is withdrawn out from the inside of the main body. For example, the plurality of operations interlocked to the cover opening/closing may include a contact/separation operation between a photosensitive drum provided in a toner cartridge and an image transfer unit through tray elevation, an electrical connection/release operation between a contact terminal of a high-voltage power supply unit and a high-voltage terminal provided in a toner cartridge, and a coupling/separation operation between a driving coupler and the photosensitive drum and one side of a developing roller provided in the toner cartridge, according to the opening/closing operation of the cover. In this example, an image transfer belt unit as an example of the image transfer unit according to an example will be described.

Figure 1B:
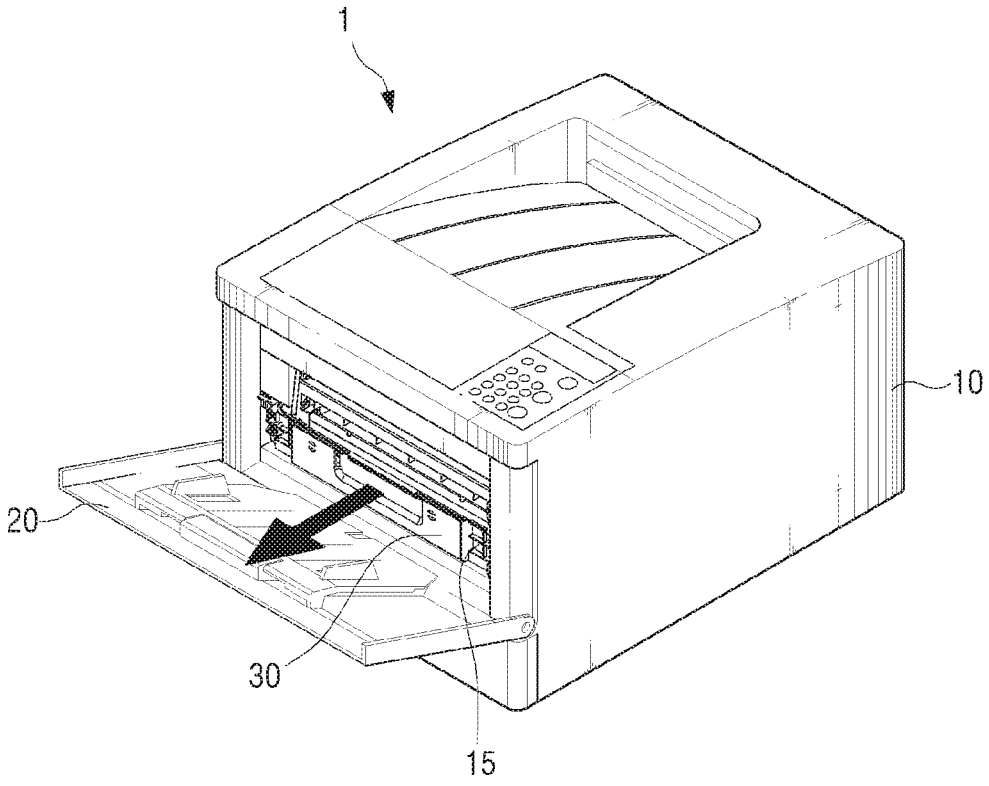
FIG. 1B and FIG. 1C are perspective views illustrating image forming apparatuses that a door is opened and a tray for a toner cartridge is pulled out from a main body according to an example.
Figure 1C:
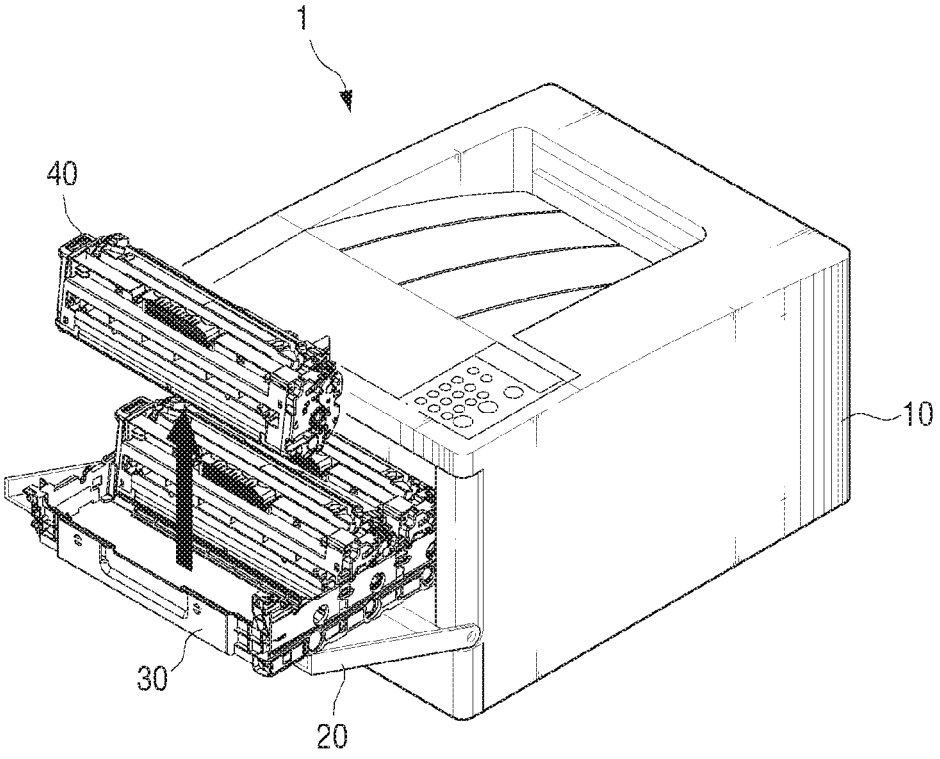

FIG. 1A is a perspective view illustrating an image forming apparatus according to an example and FIGS. 1B and 1C are perspective views illustrating image forming apparatuses that a door is opened and a tray for a toner cartridge is pulled out from a main body according to an example.

A schematic configuration of an image forming apparatus 1 according to an example will be described before a configuration for a contact application/release operation of a customer replacement unit memory (CRUM) interlocked to the tray is described.

Referring to FIGS. 1A to 1C, the image forming apparatus 1 may include a main body 10 and a toner cartridge 40 separably disposed in the main body 10 and may transfer a visible image onto a recording medium (hereinafter, referred to as 'paper') (not shown) through contact with a photosensitive drum (see 46 of FIG. 22) provided in the toner cartridge 40. The image forming apparatus 1 may further include a fixing device (not shown) which is located in the inner side of the main body 10 and pressurizes the paper in which an image is formed through an image transfer belt unit (see 13 of FIG. 22) at high temperature. The image forming apparatus 1 may further include a paper tray 11 onto which the paper is loaded.

The main body 10 may include a cover 20 configured to open and close an opening 15 through which a tray 30 for a toner cartridge (hereinafter, referred to as 'tray 30') is pulled out from the main body. A lower end of the cover 20 may be hinge-coupled to the main body 10. As illustrated in FIG. 1B, an upper end of the cover 20 may be pulled to an outer direction of the main body 10 and thus the opening 15 of the main body 10 may be opened in response to the tray 30 being pulled out from the main body.

Figure 8:
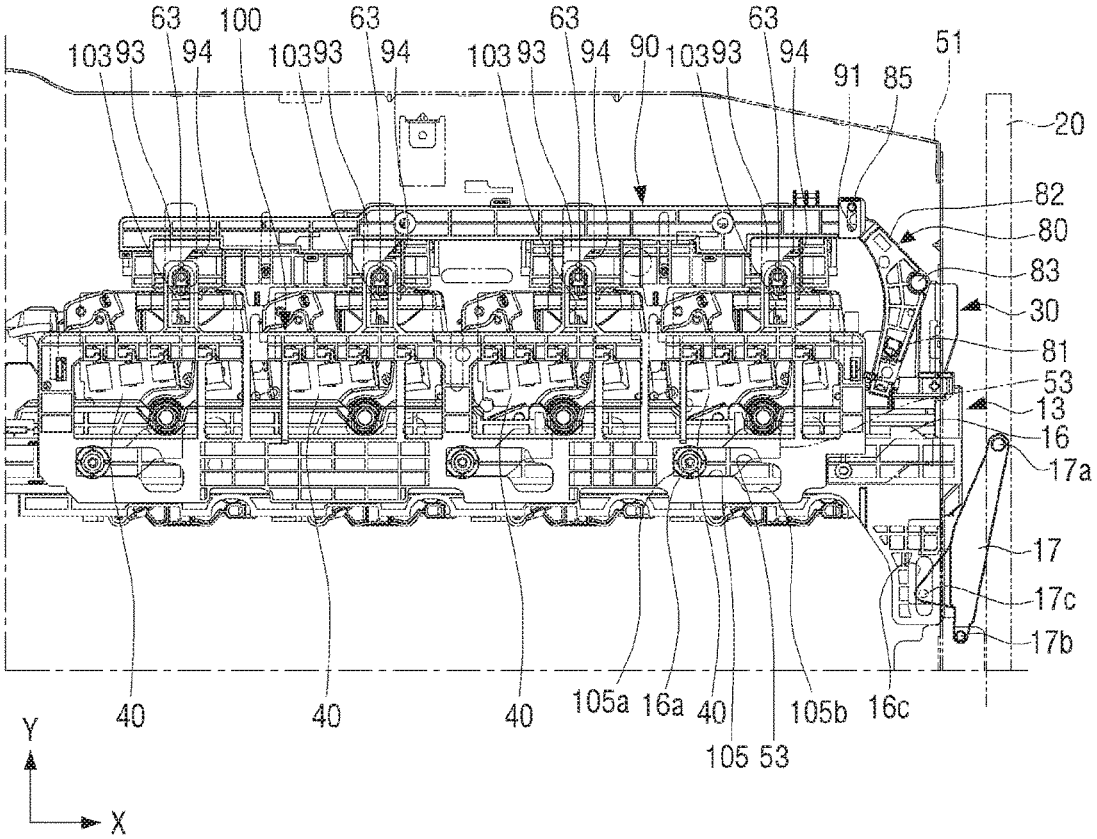
FIG. 8 is a diagram illustrating a support frame which elastically supports a CRUM contact unit with the interlocking structure of FIG. 4 according to an example.

The cover 20 may be coupled to a guide rail 16 through a cover coupling lever 17 (see FIG. 8). An upper-end portion 17*a* of the cover coupling lever 17 may be hinge-coupled to the cover 20, a lower-end portion 17*b* thereof may be hinge-coupled to a portion of a first side frame 51, and an extension portion 17*c* thereof extending from a rear of the lower-end portion 17*b* may be slidably movably coupled to an elongated hole 16*c* of the guide rail 16. Accordingly, the cover coupling lever 17 may rotate clockwise about the lower-end portion 17*b* to pull the guide rail 16 to a +X-direction in response to the cover 20 being opened and may rotate counterclockwise about the lower-end portion 17*b* to push the guide rail 16 to a −X-direction in response to the cover 20 being closed and thus the guide rail 16 may be moved to an X-direction.

A plurality of toner cartridges 40 may be separately placed in the tray 30 as illustrated in FIG. 1C. The tray 30 may be slidably located in the main body 10 to be pushed into the inner side of the main body 10 or to be pulled out toward the outer side of the main body 10. Each of the plurality of toner cartridges 40 may include a toner storage unit (not shown) and a developing roller (not shown) and toners having different colors, for example, cyan (C), magenta (M), yellow (Y), and black (K) may be loaded into the toner storage unit.

Hereinafter, a structure for performing a CRUM contact application/release operation in conjunction with an operation of the tray 30, for example, an electrical connection/release operation between a contact terminal (see 61 of FIG. 2) of a CRUM contact unit 60 and a terminal (43 of FIG. 7)

of a CRUM provided in the toner cartridge 40 will be described with reference to the accompanying drawings.

Figure 2:
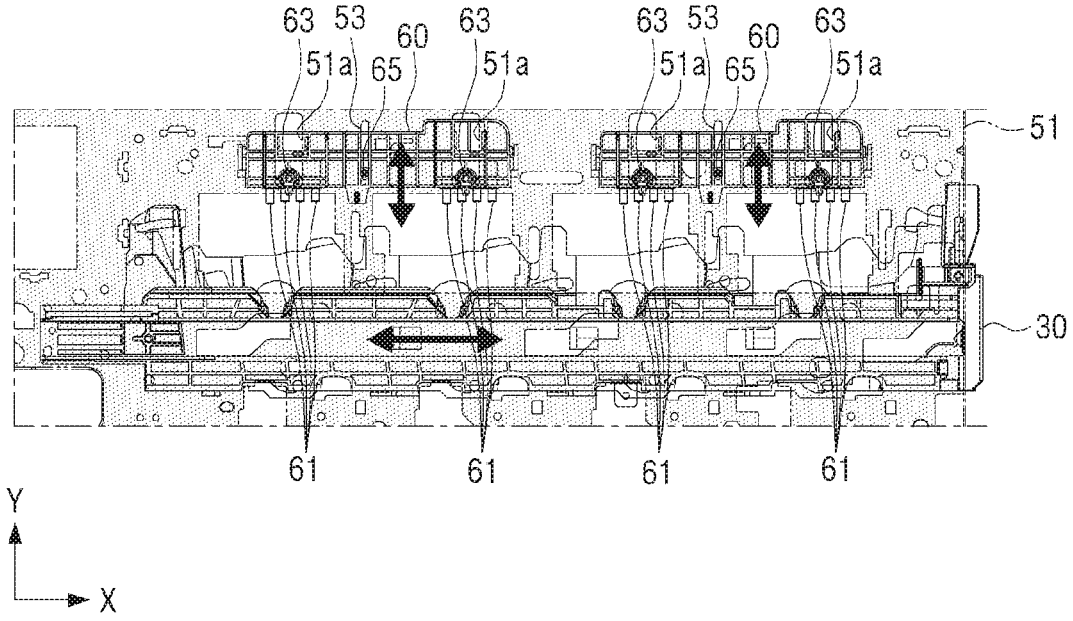
FIG. 2 is a diagram illustrating a moving direction of a tray and a moving direction of a CRUM contact unit according to an example.

FIG. 2 is a diagram illustrating a moving direction of a tray and a moving direction of a CRUM contact unit according to an example and FIG. 3 is a diagram illustrating a coupling structure for elevating a CRUM contact unit according to tray push-in/pull-out according to an example.

Referring to FIG. 2, left and right sides of the tray 30 may be slidably coupled to a first side frame 51 and a second side frame (see 55 of FIG. 25A) provided in the inside of the main body 10 along the X-direction. For example, the guide rail (see 16 of FIG. 8) slidably supported by the left and right sides of the tray 30 may be disposed in inner side surfaces of the first and second side frames 51 and 55.

A plurality of CRUM contact units 60 may be located at intervals over the tray 30. Each of the plurality of CRUM contact units 60 may include a plurality of contact terminals 61 which are in contact with a plurality of terminals 43 of CRUMs provided in each of the plurality of toner cartridges 40. For example, the CRUM may refer to a semiconductor memory configured to improve image quality of a toner cartridge or manage lifespan of a toner in the toner cartridge. In this example, information, for example, a serial number of a toner cartridge, a cartridge supplier, a remaining quantity of a toner, a toner state, and the like, may be stored in the CRUM. A controller (not shown) provided in the image forming apparatus may perform an operation which reads information stored in the CRUMs and stores information for a remaining quantity of a toner according to a printing job in the CRUMs, through the plurality of CRUM contact units 60.

A plurality of first guide protrusions 63 which protrude from an inner side of the first side frame 51 toward an outer side of the first side frame 51 through a plurality of through holes 51*a* formed in the first side frame 51 may be formed in one side surface of each of the plurality of CRUM contact units 60. The plurality of through holes 51*a* may have an elongated shape and may be formed along a Y-direction. The plurality of first guide protrusions 63 may be slidably movably inserted into guide holes 103 of a support frame 100 to be described later (see FIG. 6).

A plurality of second guide protrusions 65 may be formed in the one side surface of each of the plurality of CRUM contact units 60 in which the plurality of first guide protrusions 63 are formed. The plurality of second guide protrusions 65 may be slidably movably inserted into the elongated guide holes 53 formed in the first side frame 51 along the Y-direction. The plurality of CRUM contact units 60 may be located in the inner side of the first side frame 51 and may perform an elevating operation to the Y-direction as the second guide protrusions 65 are guided through the guide holes 53 of the first side frame 51.

Figure 3A:
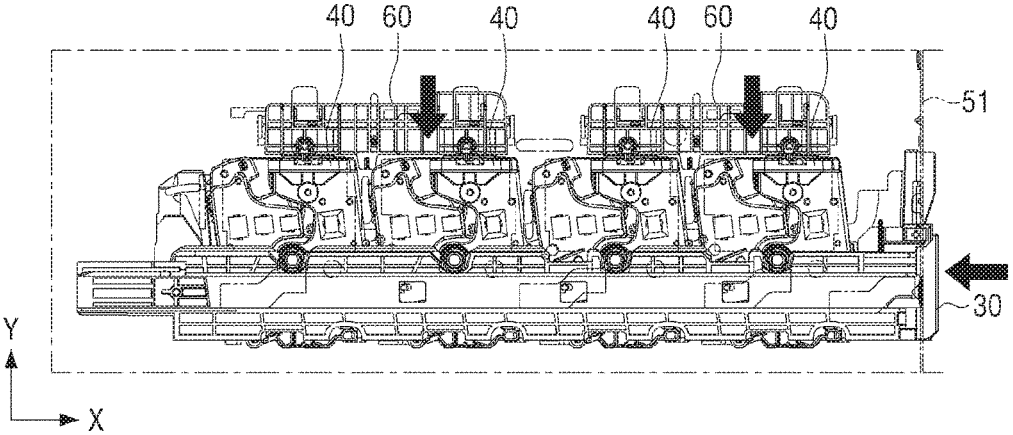
FIG. 3A and FIG. 3B illustrate an operation that a CRUM contact unit descends and a terminal of the CRUM contact unit is coupled to a terminal of a CRUM of a toner cartridge according to push-in of a tray into an inside of a main body in a state that the tray is pulled out from the main body according to an example.
Figure 3B:
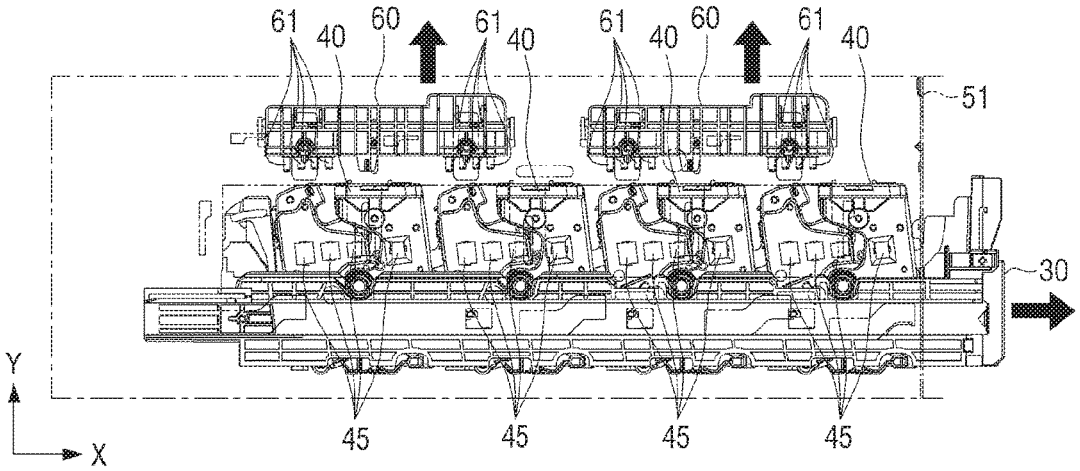

FIGS. 3A and 3B illustrate an operation that a CRUM contact unit descends and a contact terminal of the CRUM contact unit is coupled to a terminal of a CRUM of a toner cartridge as a tray is pushed into an inside of a main body in a state that the tray is pulled out from the main body according to an example.

Referring to FIG. 3A, in response to the tray 30 being pushed into a position that the tray 30 is not moved anymore to an inner-side direction (the −X-direction) of the main body 10, the plurality of CRUM contact units 60 may descend to a downward direction (the −Y-direction) in conjunction with the push-in operation of the tray 30. The terminals 43 of the CRUM of the toner cartridge 40 may be set to a connection position that the terminals 43 are coupled to the plurality of contact terminals 61 of each of the plurality of CRUM contact units 60. Accordingly, the plurality of CRUM contact units 60 may descend and thus the plurality of contact terminals 61 of each of the plurality of CRUM contact units 60 may be coupled to the terminals 43 of the plurality of CRUMs provided in each of the plurality of toner cartridges 40.

Referring to FIG. 3B, in response to the tray 30 being pull out toward to an outer-side direction (the +X-direction) of the main body 10 in a state that the terminals 43 and 61 are coupled to each other, the plurality of CRUM contact units 60 may rise to an upward direction (the +Y-direction) in conjunction with the pull-out operation of the tray 30. Accordingly, the connection between the terminals 43 and 61 may be released.

Hereinafter, an interlocking unit configured to interlock an elevation operation of the plurality of CRUM contact units 60 according to the push-in/pull-out operation of the tray 30 will be described with reference to FIGS. 4 to 8.

Figure 4:
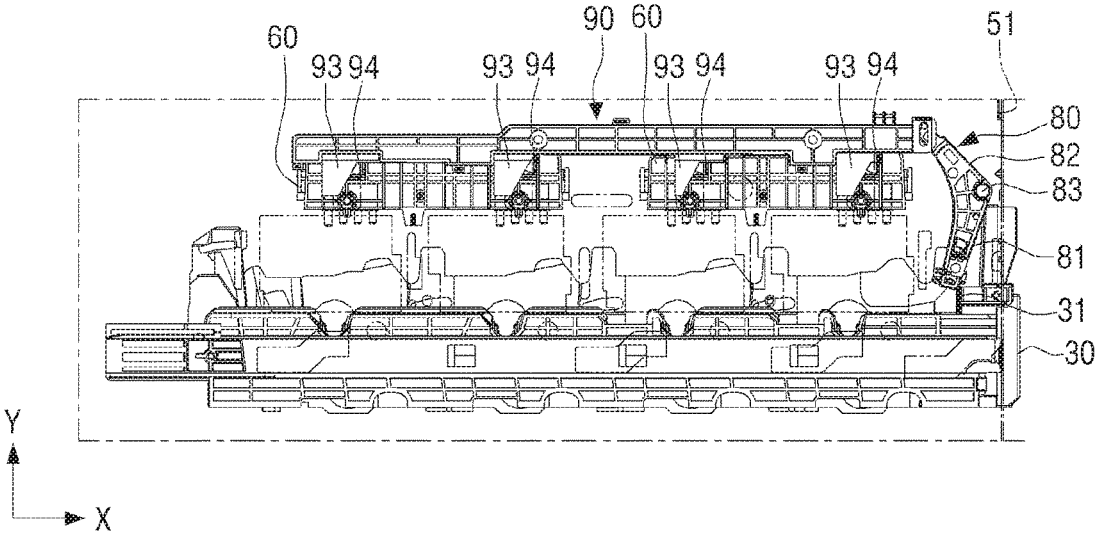
FIG. 4 is a diagram illustrating an interlocking structure for elevating a CRUM contact unit according to push-in and pull-out of a tray according to an example.
Figure 5:
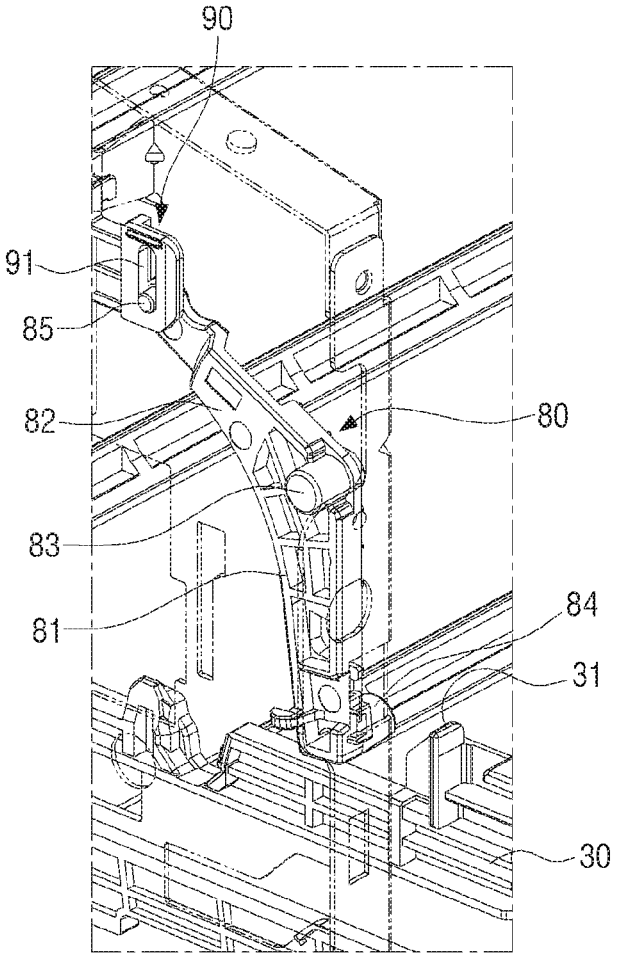
FIG. 5 is a diagram illustrating an example that both ends of a lever illustrated in FIG. 4 are hinge-coupled to a portion of a tray and a link member coupled to a CRUM contact unit according to an example.

FIG. 4 is a diagram illustrating an interlocking structure for elevating a CRUM contact unit according to push-in and pull-out of a tray according to an example and FIG. 5 is a diagram illustrating an example that both ends of a lever are hinge-coupled to a portion of a tray and a link member coupled to a CRUM contact unit according to an example.

Referring to FIG. 4, the interlocking unit may be a structure configured to interlock an elevation operation of the CRUM contact unit 60 with the push-in/pull-out operation of the tray 30 and may include a lever 80 and a link member 90.

The lever 80 may mutually couple the tray 30 and the link member 90 and may be rotatably coupled to the first side frame 51. The lever 80 may rotate clockwise and counterclockwise through the push-in/pull-out operation to linearly move the link member 90 to a moving direction of the tray 30 and an opposite direction to the moving direction of the tray 30.

The lever 80 may be formed so that one-side portion 81 thereof extends to a direction close to the tray 30 and the other-side portion 82 thereof extends to a direction close to the CRUM contact unit 60 in a state bent to a fixed angle with respect to the one-side portion 81.

A hinge shaft 83 of the lever 80 may be formed in a portion that the one-side portion 81 and the other-side portion 82 are in contact with each other. The hinge shaft 83 may be rotatably coupled to a portion of the first side frame 51. Accordingly, the lever 80 may rotate clockwise and counterclockwise about the hinge shaft 83.

Referring to FIG. 5, a locking protrusion 84 may be formed in a front end of the one-side portion 81 of the lever 80. The push rib 31 formed in the tray 30 may interfere with the locking protrusion 84 in response to the tray 30 being pushed into the main body 10. The lever 80 may rotate clockwise about the hinge shaft 83.

The other-side portion 82 of the lever 80 may be coupled to the link member 90 through a coupling protrusion 85 formed in a front end of the other-side portion 82. The coupling protrusion 85 may be slidably inserted into an elongated hole 91 formed in one end of the link member 90.

For example, the push rib 31 may interfere with the locking protrusion 84 through the tray 30 which moves toward the inner side of the main body 10 and thus the other-side portion 82 of the lever 80 may rotate clockwise to pull the link member 90. Accordingly, the link member 90 may move to the pull-out direction (the +X-direction) of the tray 30. In another example, the interference of the push rib 31 with the locking protrusion 84 may be released through the pull-out of the tray 30 toward the outer side of the main body 10 and thus the other-side portion 82 of the lever 80 may rotate counterclockwise to push the link member 90. Accordingly, the link member 90 may move to the push-in direction (the −X-direction) of the tray 30.

Figure 6A:
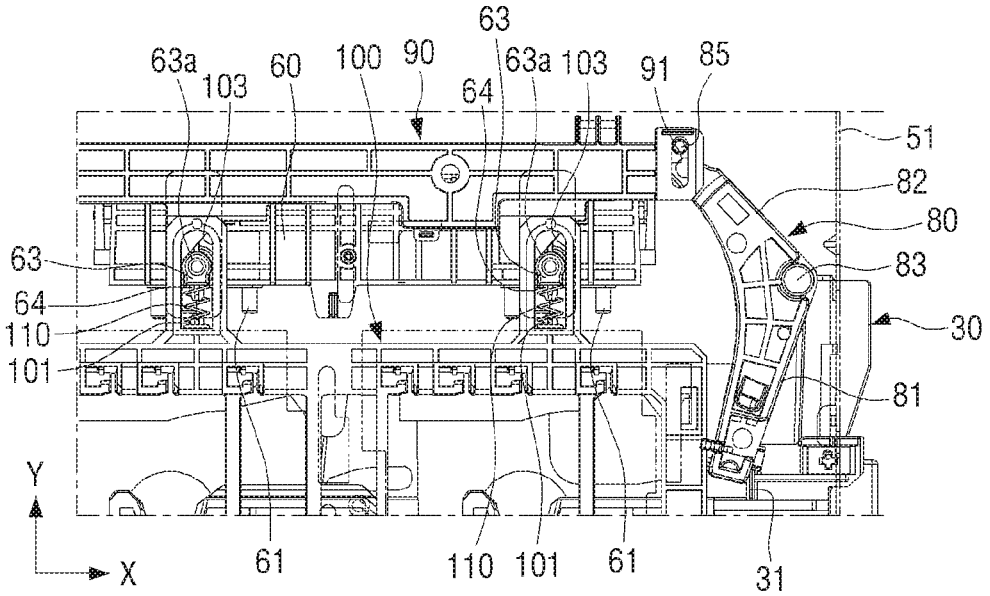
FIG. 6A and FIG. 6B illustrate a structure for falling a CRUM contact unit through a linear movement of a link member according to an example.
Figure 6B:
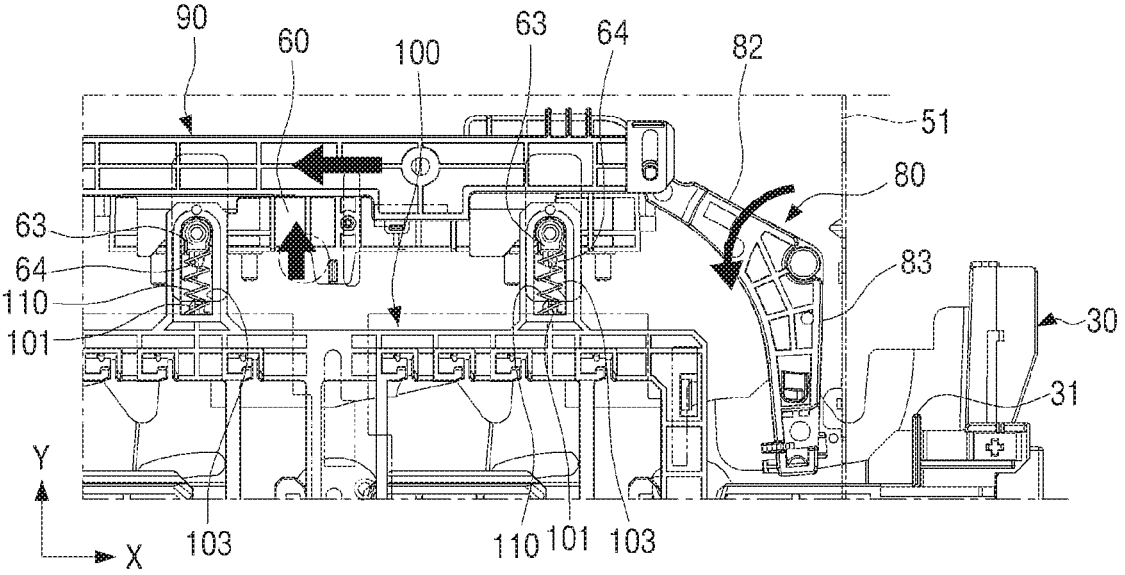

FIG. 6A and FIG. 6B illustrate a structure for lowering a CRUM contact unit through a linear movement of a link member according to an example and FIG. 7 is a diagram illustrating an example that a CRUM contact unit elastically supported by a support frame rises through release of pressure applied to a link member and contact between a terminal of the CRUM contact unit and a terminal of a CRUM is released in response to a tray being pulled out from a main body in a state that the tray is pushed into an inside of the main body according to an example.

Referring to FIG. 6A, the link member 90 may linearly move according to the rotation of the lever 80 and simultaneously may perform pressure and pressure release on portions of the plurality of CRUM contact units 60. Accordingly, the plurality of CRUM contact units 60 may be simultaneously elevated to the Y-direction.

A plurality of cam protrusions 93 may protrude downward at intervals from a lower end of the link member 90. A cam-end portion 94 inclined to a fixed angle may be formed in each of the plurality of cam protrusions 93. The cam-end portion 94 may be inclined to the tray push-in direction (the −X-direction) from an upper end thereof toward a lower end thereof.

Figure 7A:
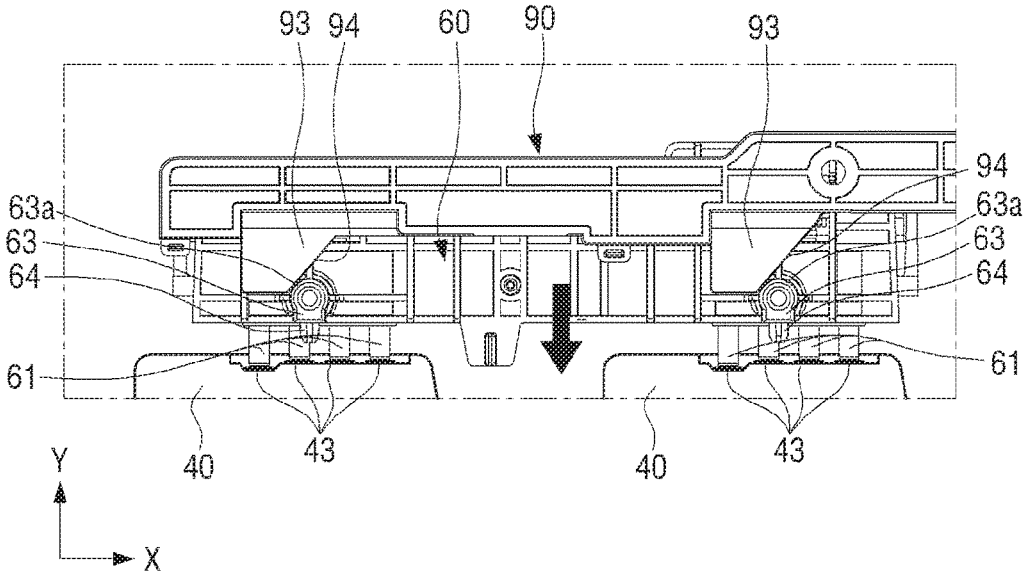
FIG. 7A and FIG. 7B illustrate an example that a CRUM contact unit elastically supported by a support frame rises through release of pressure applied to a link member and contact between a terminal of the CRUM contact unit and a terminal of a CRUM is released in response to a tray being pulled out from a main body in a state that the tray is pushed into an inside of the main body according to an example.

For example, the link member 90 may move to the tray pull-out direction (the +X-direction) through the rotation of the lever 80 as illustrated in FIG. 6A and thus the first guide protrusion 63 of each CRUM contact unit 60 may interfere with each cam protrusion 93. The cam-end portion 94 may be in cam contact with a rounded top surface 63*a* of the first guide protrusion 63 to pull out the first guide protrude 63 and the CRUM contact units 60 may simultaneously descend to the −Y-direction. Accordingly, the plurality of terminals 61 of each CRUM contact unit 60 may be electrically coupled to the terminals 43 of the CRUM located over the toner cartridge 40 as illustrated in FIG. 7A.

Figure 7B:
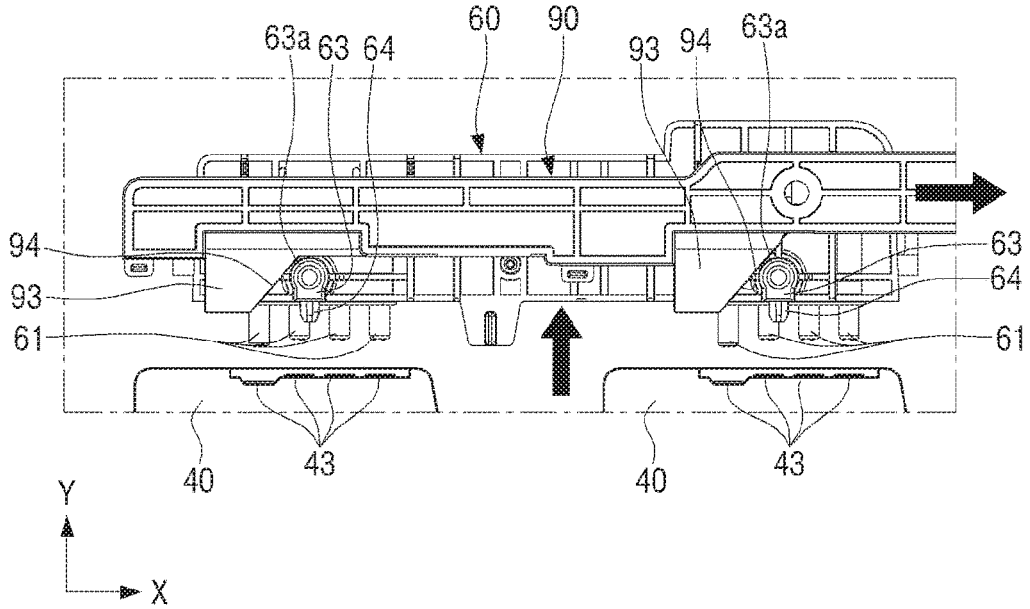

In an example, the link member 90 may move to the tray push-in direction (the −X-direction) through the rotation of the lever 80 as illustrated in FIG. 6B and thus the cam protrusion 93 which pressurizes the first guide protrusion 63 of each CRUM contact unit 60 may move to the tray push-in direction (the −X-direction) with the link member 90. Accordingly, the interference of the cam protrusion 93 with the first guide protrusion 63 of the CRUM contact unit 60 may be released and thus the plurality of contact units 60 may rise to the +Y-direction. A structure for the rising operation of each CRUM contact unit 60 will be described below with reference to FIG. 8. The electrical connection between the plurality of terminals 61 of each CRUM contact unit 60 and the terminals 43 of the CRUM located over the toner cartridge 40 may be released as illustrated in FIG. 7B.

Figure 9:
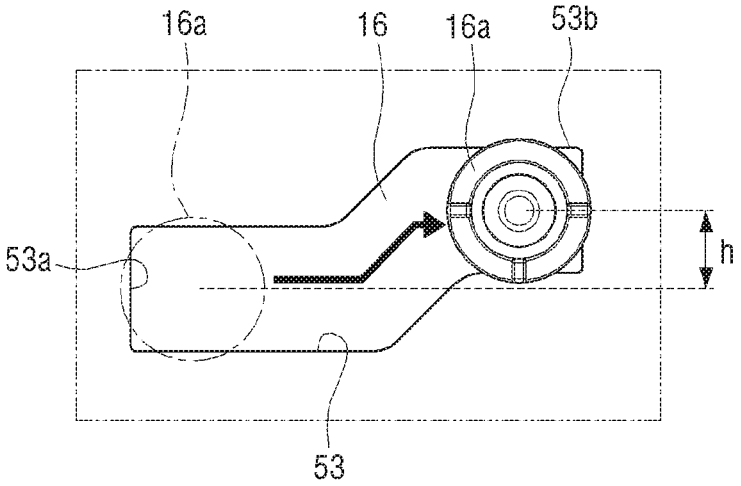
FIG. 9 is an enlarged view illustrating an example that a guide roller of a guide rail moves along a cam hole formed in a first side frame according to an example.

FIG. 8 is a diagram illustrating a support frame which elastically supports a CRUM contact unit with the interlocking structure of FIG. 4 according to an example and FIG. 9 is an enlarged view illustrating an example that a guide roller of a guide rail moves along a cam hole formed in a first side frame according to an example.

The plurality of CRUM contact units 60 may be elastically supported through a plurality of compression springs 110 located in portions of a support frame 100.

For example, one end of each of the plurality of compression springs 110 may be coupled to a fixing portion 64 which protrudes from a lower end of the first guide protrusion 63 of the CRUM contact unit 60 and the other end of the compression spring 110 may be coupled to a fixing protrusion 101 formed in the support frame 100 as illustrated in FIG. 6A. Accordingly, the plurality of CRUM contact units 60 may be elastically supported to the Y-direction through the plurality of compression springs 110.

The support frame 100 may be elevated to the Y-direction in conjunction with the movement of the guide rail 16 to the tray push-in/pull-out direction. For example, a plurality of cam holes 105 to which a plurality of rollers 16*a* located in one side of the guide rail 16 are slidably movably coupled may be formed in the support frame 100. Each of the plurality of cam holes 105 in the support frame 100 may be formed to be stepped so that a left side 105*a* of the cam hole 105 is located higher than a right side 105*b* thereof as illustrated in FIG. 8. A plurality of guide holes 103 to which the plurality of first guide protrusions 63 are slidably coupled may be formed in an upper end of the support frame 100. The plurality of guide holes 103 may be formed along the Y-direction and thus the support frame 100 may be guided through the plurality of first guide protrusions 63 to the Y-direction.

Force which pressurizes the plurality of CRUM contact units 60 to the +Y-direction according to the opening operation of the cover 20 may be accumulated in the support frame 100. The accumulated force may move the plurality of CRUM contact units 60 upward in response to the interference of the link member 90 being released. Hereinafter, an operation of the support frame 100 interlocked to the opening of the cover 20 will be described below.

The support frame 100 may be located in a descending position in a state that the cover 20 is closed as illustrated in FIG. 8. In response to the cover 20 being opened, the guide rail 16 may move by a fixed distance to the tray pull-out direction in conjunction with the opening operation of the cover 20 and simultaneously, the plurality of guide rollers 16*a* of the guide rail 16 may move upward along the cam hole 53 formed in the first side frame 51 as illustrated in FIG. 9. For example, the plurality of cam holes 53 of the first side frame 51 may be formed to be stepped so that a left side 53*a* is located lower than a right side 53*b* as opposite to the plurality of cam holes 105 of the support frame 100.

As illustrated in FIG. 9, in response to the plurality of guide rollers 16*a* being moved to the right sides 53*b* of the plurality of cam holes 53 of the first side frame 51 from the left sides 53*a* thereof, the guide rail 16 may move upward by a fixed height h.

The plurality of guide rollers 16*a* may move from the left sides 53*a* of the plurality of cam holes 53 of the first side frame 51 to the right sides 53*b* thereof and simultaneously, the plurality of guide rollers 16*a* may move the left sides 105*a* of the plurality of cam holes 105 of the support frame 100 to the right sides 105*b* thereof. Accordingly, the support frame 100 may rise by the same height as the rising height h of the guide rail 16. In response to the support frame 100 being raised, the plurality of compression springs 110 may be compressed as illustrated in FIG. 6A and the force which may raise the plurality of CRUM contact units 60 to the +Y-direction may be increased. For example, since the plurality of CRUM contact units 60 is pressurized to the −Y-direction through the cam protrusion 93 of the link member 90, the plurality of CRUM contact units 60 may not move upward and may be maintained in a corresponding position as it is.

In response to the tray 30 being pulled out from the main body 10 to the +X-direction, the plurality of CRUM contact units 60 with which the link member 90 interferes may rise to the +Y-direction through the accumulated elastic force.

Accordingly, the plurality of contact terminals 61 of the plurality of CRUM contact units 60 may be spaced from the terminals 43 of the CRUMs of the toner cartridge 40 and thus the connection between the terminals 61 and 43 may be released.

The above-described lever 80 may have no elastically supported structure and thus the lever 80 may not perform an operation which pushes the link member 90 to the −X-direction in response to the interference of the push rib 31 being released. For example, the link member 90 may move to the −X-direction through the rising operation of the plurality of CRUM contact units 60 elastically supported through the support frame 100. In response to the lever 80 being elastically supported through an elastic member, the lever 80 may perform an operation which pushes the link member 90 to the −X-direction.

Hereinafter, various examples that the lever 80 is elastically supported through the elastic member will be described with reference to FIGS. 10A to 10C.

Figure 10A:
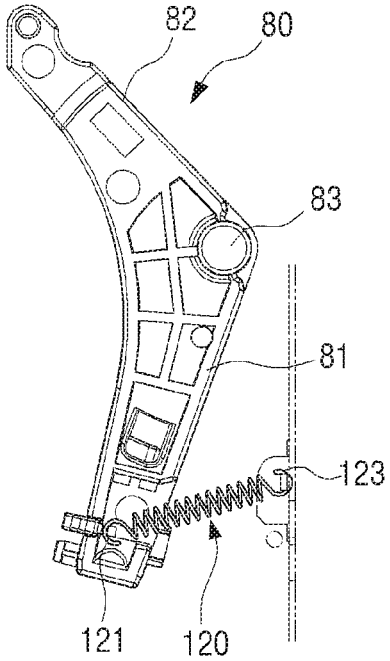
FIGS. 10A, 10B, and 10C are diagrams illustrating various types of elastic members for operating a lever according to an example.
Figure 10B:
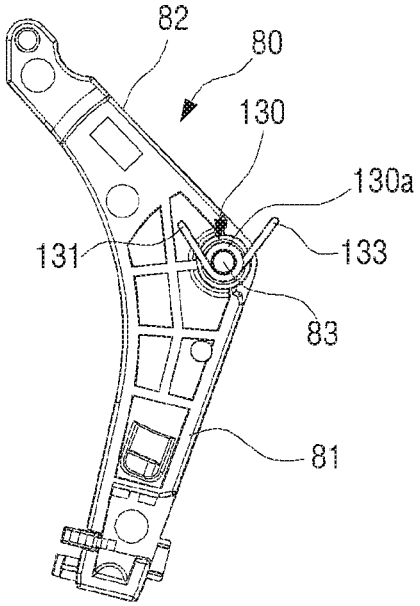
Figure 10C:
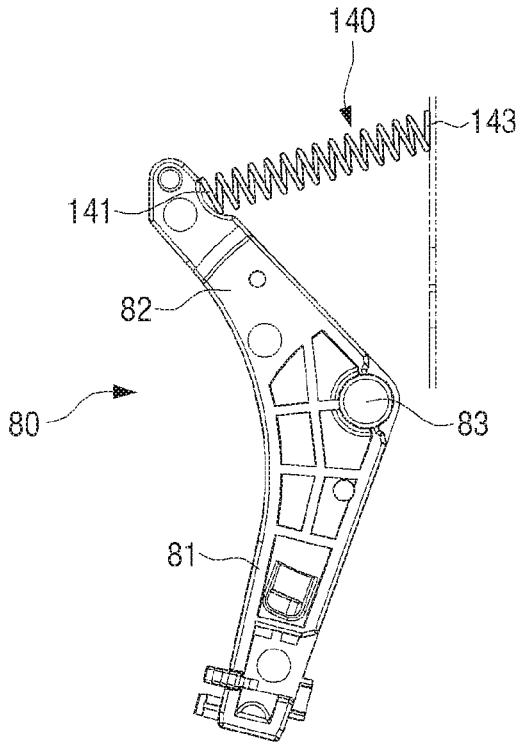

FIGS. 10A to 10C are diagrams illustrating various types of elastic members for operating a lever according to an example.

Referring to FIG. 10A, the one-side portion 81 of the lever 80 may be elastically supported through a tension spring 120. One end 121 of the tension spring 120 may be fixed to the one-side portion 81 and the other end 123 may be fixed to a portion of the first side frame 51.

The one-side portion 81 of the lever 80 may be pushed through the push rib 31 of the tray 30 in a state that the tray 30 is pushed into the main body 10 and thus the lever 80 may rotate clockwise. For example, the tension spring 120 is stretched and the elastic force of the tension spring 120 may be increased. In this example, in response to the tray 30 being moved to the pull-out direction of the tray 30, the lever 80 may rotate counterclockwise through elastic force of the tension spring 120 and may push and move the link member 90 to the −X-direction while the interference of the push rib 31 is released.

Referring to FIG. 10B, the lever 80 may be elastically supported through a torsion spring 130. A winding portion 130*a* of the torsion spring 130 may be coupled to the hinge shaft 83 and one end 131 of the torsion spring 130 which extends from the winding portion 130*a* may be fixed to a portion of the lever 80 and the other end 133 of the torsion spring 130 which extends from the winding portion 130*a* may be fixed to a portion of the first side frame 51.

Accordingly, in response to the tray 30 pushed into the main body 10 being moved to the pull-out direction of the tray 30, the lever 80 may rotate counterclockwise through the increased elastic force of the torsion spring 130 and may push and move the link member 90 to the −X-direction while the interference of the push rib 31 is released.

Referring to FIG. 10C, the other-side portion 82 of the lever 80 may be elastically supported through a compression spring 140. One end 141 of the compression spring 140 may be fixed to the other-end portion 82 of the lever 80 and the other end 143 of the compression spring 140 may be fixed to a portion of the first side frame 51.

Accordingly, in response to the tray 30 pushed into the main body 10 being moved to the pull-out direction, the lever 80 may rotate counterclockwise through the increased elastic force of the compression spring 140 and may push and move the link member 90 to the −X-direction while the interference of the push rib 31 may be released.

The example that the lever 80 is elastically supported through the elastic member and smoothly performs the operation of the link member 90 has been described. A structure that pushes the link member 90 to the −X-direction through the lever 80 without an elastic member will be described with reference to FIGS. 11 and 12.

Figure 11:
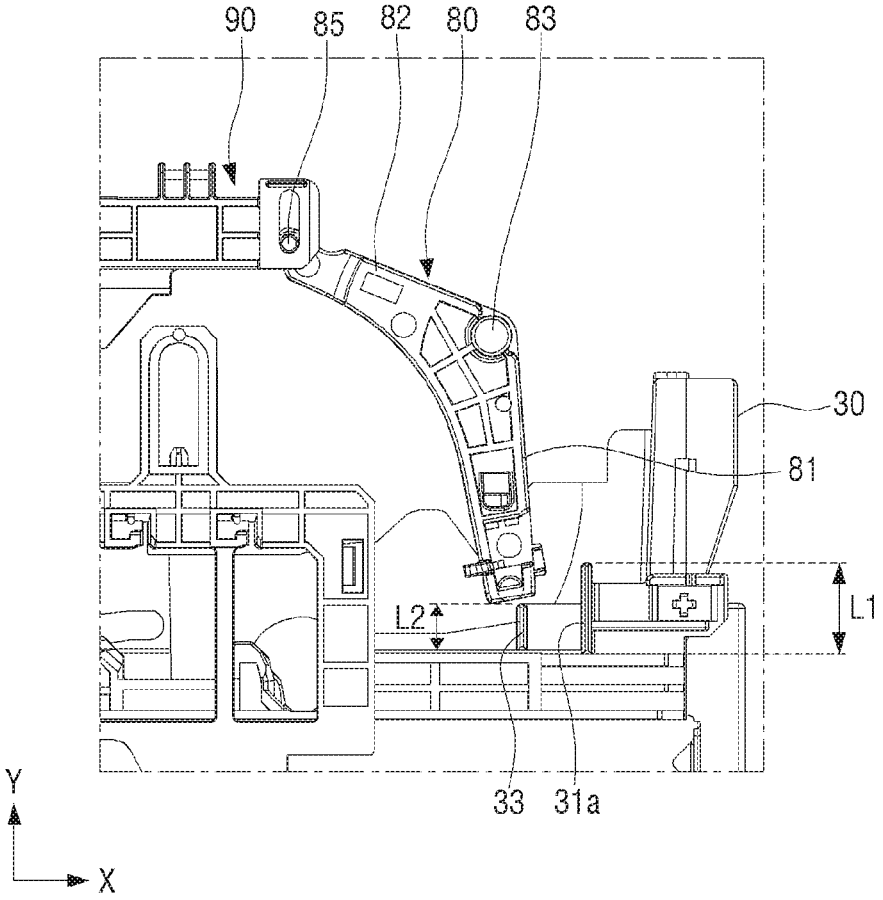
FIG. 11 is a diagram illustrating an example of a tray including first and second push ribs for operating a lever according to an example.

FIG. 11 is a diagram illustrating an example of a tray including first and second push ribs for operating a lever according to an example and FIG. 12 is a diagram illustrating an example that a tray rotates clockwise through a first push rib in a pull-out operation of the tray and the tray rotates counterclockwise through a second push rib in a push-in operation of the tray according to an example.

Referring to FIG. 11, the tray 30 may include a first push rib 31*a* having the same structure and function as the push rib 31 illustrated in FIG. 5 and a second push rib 33 located to be spaced at a fixed interval from the first push rib 31*a*. For example, the first and second push ribs 31*a* and 33 may be formed to have a distance therebetween slightly larger than a width of the one-side portion 81 of the lever 80 so that one-side portion 81 of the lever 80 is located between the first and second push ribs 31*a* and 33.

A top height L1 of the first push rib 31*a* may be located in a position sufficient to interfere with a portion 81*a* of the one-side portion 81 of the lever 80 in the push-in operation of the tray 30.

The second push rib 33 may be located closer to the plurality of CRUM contact units 60 than the first push rib 31*a*. An upper end of the second push rib 33 having a top height L2 may be located lower than an upper end of the first push rib 31 having the top height L1 so that the upper end of the second push rib 33 may not interfere with the one-side portion 81 of the lever 80 in response to the one-side portion 81 of the lever 80 being pushed through the first push rib 31*a* to rotate clockwise.

Hereinafter, an operation of the lever 80 interlocked to the first and second push ribs 31*a* and 33 according to the push-in/pull-out operation of the tray 30 will be described with reference to FIG. 12.

Figure 12A:
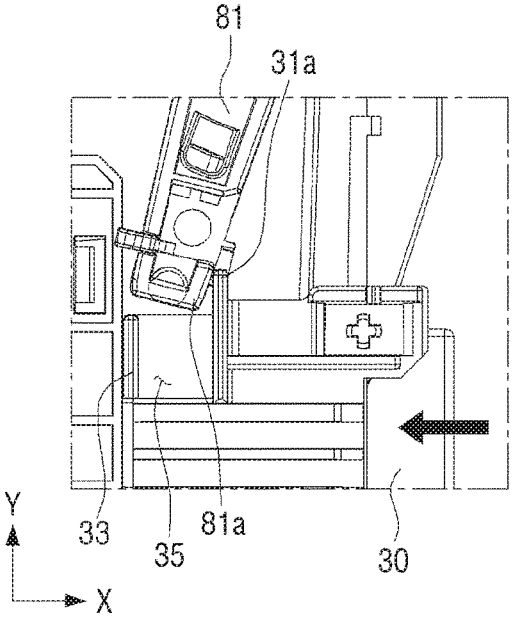
FIG. 12A and FIG. 12B illustrate an example that a tray rotates clockwise through a first push rib in a pull-out operation of the tray and the tray rotates counterclockwise through a second push rib in a push-in operation of the tray according to an example.

Referring to FIG. 12A, the tray 30 may move to the push-in direction (the −X-direction) and thus the first and second push ribs 31*a* and 33 may move to the −X-direction with the tray 30. For example, the first push rib 31*a* may push the right side 81*a* of the one-side portion 81 of the lever 80 to the −X-direction. In this example, since the second push rib 33 has the small height L2, the second push rib 31 may not interfere with the one-side portion 81 of the lever 80. The lever 80 may rotate clockwise about the hinge shaft 83 to pull the link member 90 to the +X-direction. For example, the one-side portion 81 of the lever 80 may be located in a space 35 formed between the first and second push ribs 31*a* and 33. In response to the link member 90 being moved to the +X-direction, the plurality of CRUM contact units 60 may descend through the plurality of cam protrusions 93 and the terminals 43 and 61 of the plurality of toner cartridges 40 and the plurality of CRUM contact units 60 may be electrically coupled to each other as illustrated in FIG. 7A.

Figure 12B:
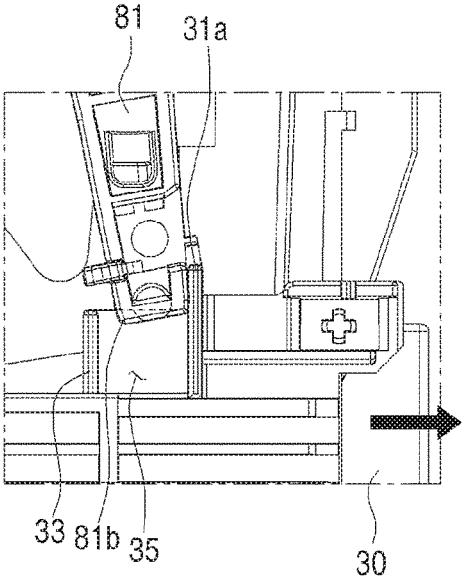

Referring to FIG. 12B, the tray 30 may move to the push-in direction (the +X-direction) of the tray 30 and thus the first and second push ribs 31*a* and 33 may move to the +X-direction with the tray 30. A lower end 81*b* of the one-side portion 81 of the lever 80 may be located lower than an upper end of the second push rib 33 and thus the one-side portion 81 of the lever 80 may be pushed through the second push rib 33. Accordingly, the lever 80 may rotate counterclockwise to push the link member 90 to the −X-direction. In response to the link member 90 being moved to the −X-direction, the plurality of CRUM contact units 60 may rise through release of the interference of the plurality of cam protrusions 93 as illustrated in FIG. 7B and the electrical connection between the terminals 43 and 61 of the plurality of toner cartridges 40 and the plurality of CRUM contact units 60 may be released.

Figure 13:
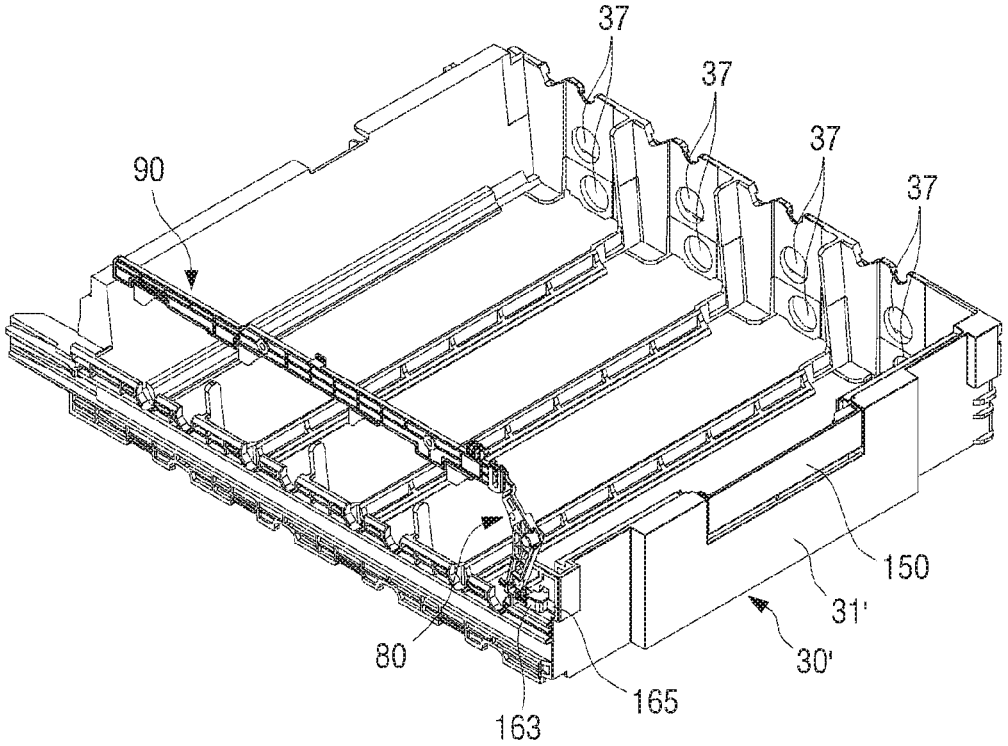
FIG. 13 is a perspective view illustrating an example that a tray includes a handle and a latch interlocked to the handle according to an example.

The lever 80 may be pushed through the first and second push ribs 31*a* and 33 to rotate clockwise and counterclockwise as described above. In another example, the lever 80 may be operated through a handle 150 provided in a tray 30' and a latch 160 interlocked to the handle 150 as illustrated in FIG. 13 other than the first and second push ribs 31*a* and 33 integrally fixed to the tray 30. In response to the handle 150 and the latch 160 being provided, the connection between the terminals 43 and 61 of the plurality of toner cartridges 40 and the plurality of CRUM contact units 60 which has been coupled to each other may be released before the pull-out operation of the tray 30. In response to the tray 30' being pulled out after the connection release between the terminals 43 and 61, the plurality of contact terminals 61 of the plurality of CRUM contact units 60 may be prevented from being scratched through the terminals 43 of the CRUMs of the plurality of toner cartridges 40 during the pull-out operation of the tray 30'.

As illustrated in FIG. 13, a plurality of first and second driving couplers (see 18*a* and 18*b* of FIG. 25A) may be inserted into a plurality of holes 37 formed in the right-side of the tray 30'. The first and second driving couplers 18*a* and 18*b* may pass through the plurality of holes 37 and may be coupled to first and second coupling parts (see 47*a* and 47*b* of FIG. 24) of the toner cartridge 40.

Hereinafter, a structure that the handle 150 and the latch 160 are provided in the tray 30 and an operation thereof will be described with reference to FIGS. 13 to 17B.

Figure 14:
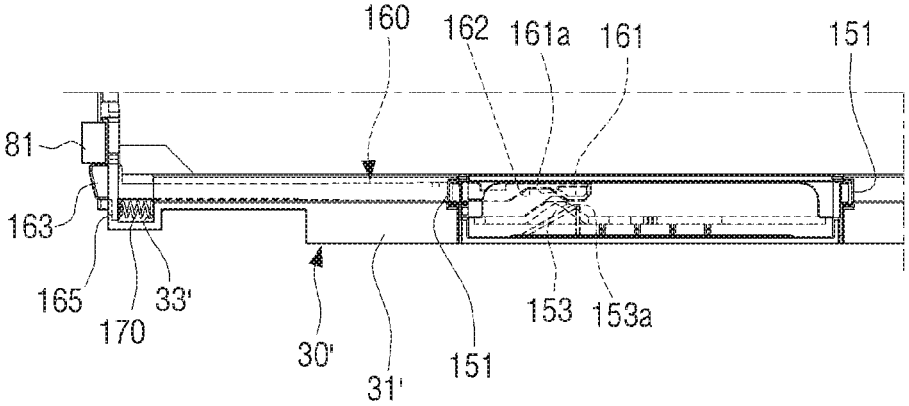
FIGS. 14 and 15 are a plan sectional diagram and a bottom view illustrating an interlocking structure between the handle and the tray illustrated in FIG. 13.
Figure 15:
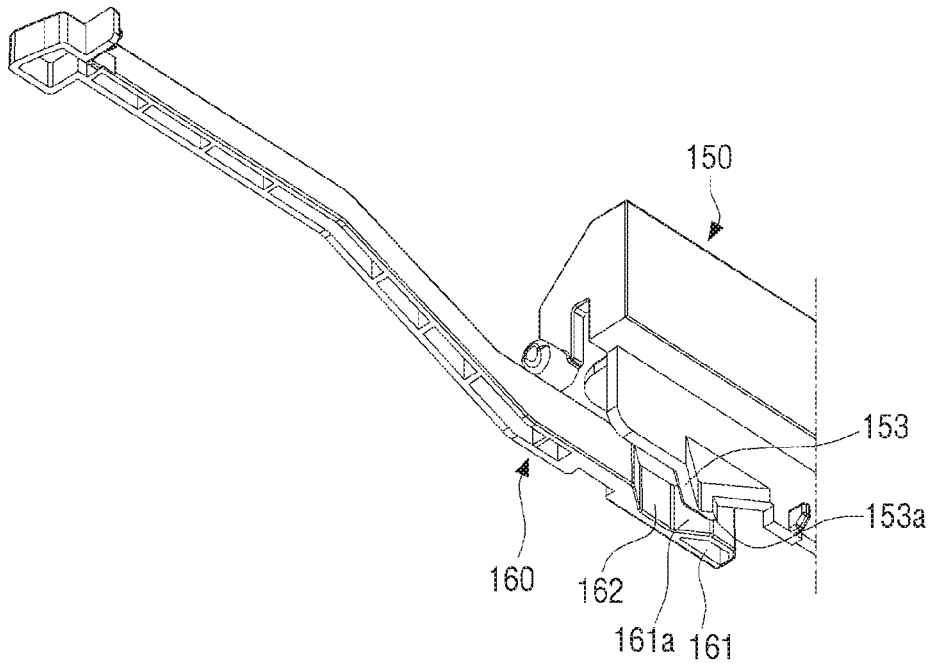
Figure 16:
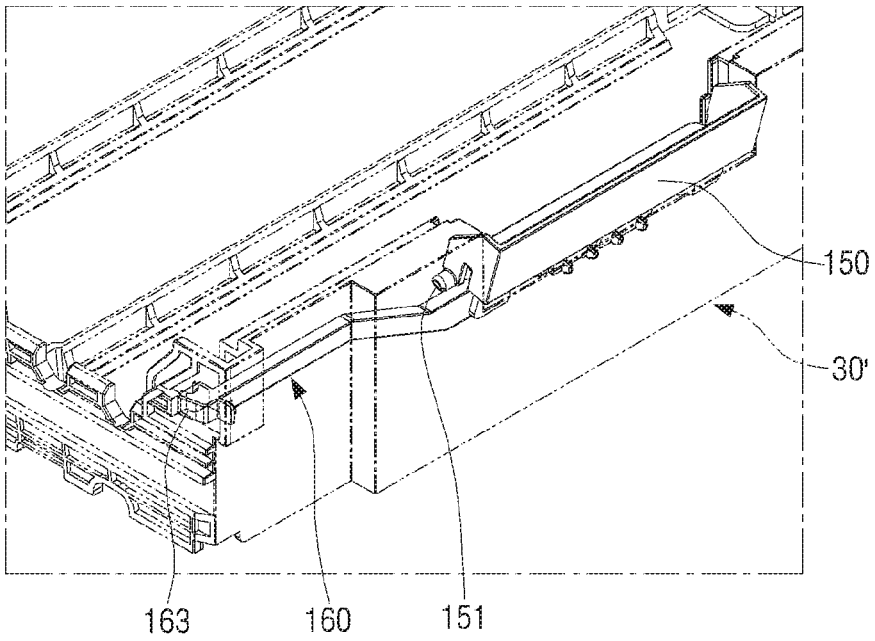
FIG. 16 is a diagram illustrating an operation example of a latch which locks and unlocks a lever according to rotation of the handle of the tray illustrated in FIG. 13.
Figure 17A:
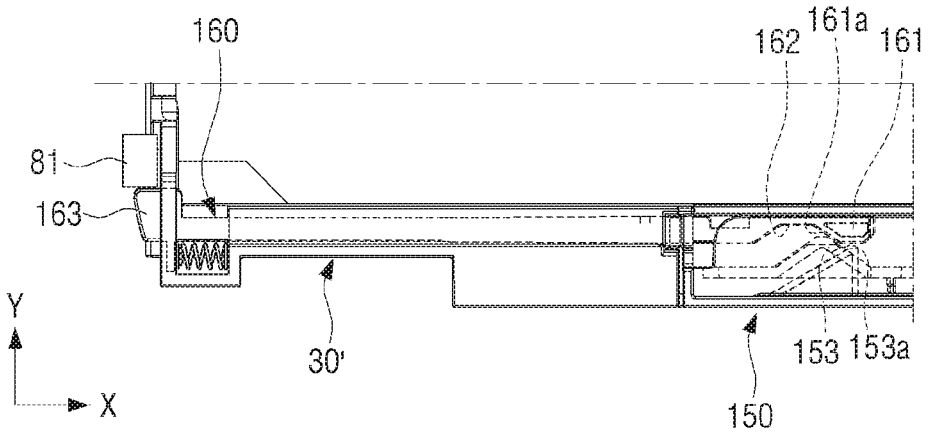
FIG. 17A and FIG. 17B illustrate an operation example of a latch interlocked according to rotation of a handle according to an example.
Figure 17B:
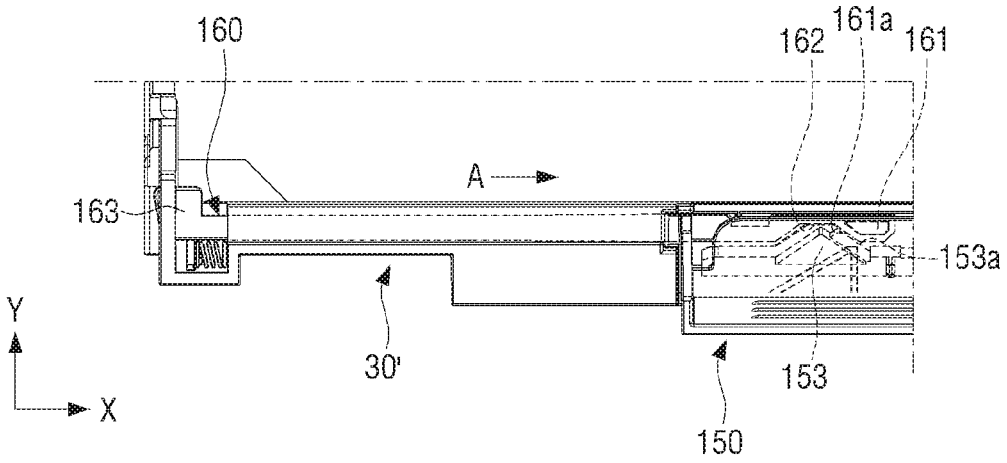

FIG. 13 is a perspective view illustrating an example that a tray includes a handle and a latch interlocked to the handle according to an example and FIGS. 14 and 15 are a plan sectional diagram and a bottom view illustrating an interlocking structure between the handle and the tray illustrated in FIG. 13. FIG. 16 is a diagram illustrating an operation example of a latch which locks and unlocks a lever according to rotation of the handle of the tray illustrated in FIG. 13 and FIG. 17A and FIG. 17B illustrate an operation example of a latch interlocked according to rotation of a handle according to an example.

Referring to FIG. 13, the handle 150 may be rotatably located in an upper side of a front-end portion 31' of the tray 30' and the latch 160 may be slidably movably disposed along a width direction of the tray 30' in an inner side of the front-end portion 31' of the tray 30'. The latch 160 may slidably move along the width direction of the tray 30' in conjunction with clockwise/counterclockwise rotation of the handle 150.

Referring to FIG. 14, hinge protrusions 151 hinge-coupled to the tray 30' may be formed in both sides of the handle 150. Accordingly, the handle 150 may rotate to a fixed angle to the tray push-in/pull-out direction. A contact protrusion 153 may be formed in an inner side of the handle 150. The contact protrusion 153 may have an inclined cam surface 153*a*.

Referring to FIGS. 14 and 15, a groove 162 to which the contact protrusion 153 of the handle 150 is coupled may be formed in a rear-end portion 161 of the latch 160. A sliding surface 161*a* which is in slidable contact with the cam surface 153*a* of the contact protrusion 153 may be formed in the groove 162.

A front-end portion 163 of the latch 160 may maintain a protruding state from one side of the tray 30' so that the one-side portion 81 of the lever 80 is pushed to the tray push-in direction in response to the handle 150 being rotated to the tray push-in direction. The front-end portion 163 of the latch 160 may be pushed into the inner side of the tray 30' to release the interference with the one-side portion 81 of the lever 80 so that the lever 80 may rotate counterclockwise in response to the handle 150 being rotated to the tray pull-out direction.

The latch 160 may be elastically supported through a compression spring 170 located close to the front-end portion 163 of the latch 160 in a sliding movement to the width direction of the tray 30'. The compression spring 170 may be located between a support rib 165 extending from one side of the front-end portion 163 of the latch 160 and a support sill 33' of the tray 30'. Accordingly, the compression spring 170 may elastically support the latch 160 to a direction that the front-end portion 163 of the latch 160 protrudes toward one side of the tray 30'.

An operation of the latch 160 interlocked to the handle 150 will be described with reference to FIGS. 16, 17A, and 17B.

As illustrated in FIG. 16, the handle 150 may rotate to the tray pull-out direction and thus the contact protrusion 153 protruding in the inner side of the handle 150 may rotate to the same direction as the rotation direction of the handle 150. For example, the contact protrusion 153 may rotates and simultaneously may move to a position further protruding to the tray push-in direction as illustrated in FIG. 17B as compared with the position illustrated in FIG. 17A. The cam surface 153*a* of the contract protrusion 153 may be in cam contact with the sliding surface 161*a* of the latch 160 and thus the latch 160 may move to an arrow A direction.

Accordingly, the front-end portion 163 of the latch 160 which supports the one-side portion 81 of the lever 80 in a state that the one-side portion of the lever 80 is pushed may be pushed into the inner side of the tray 30'. According to the release of the interference of the front-end portion 163 of the latch 160 which acts on the one-side portion 81 of the lever 80, the lever 80 may rotate counterclockwise. Accordingly, the plurality of CRUM contact units 60 may rise through the elastic force of the compression spring 170 provided in the support frame 100 as illustrated in FIG. 6B and thus the link member 90 may move to the tray push-in direction and simultaneously, the lever 80 may rotate counterclockwise.

Hereinafter, a plurality of operations which are performed in conjunction with the opening/closing of the cover 20 in the image forming apparatus 1 according to an example will be described with reference to FIGS. 18 to 27.

First, an electrical connection/release operation between a contact terminal of a high-voltage power supply unit and a high-voltage terminal provided in a toner cartridge will be described with reference to FIGS. 18 to 21B.

Figure 18:
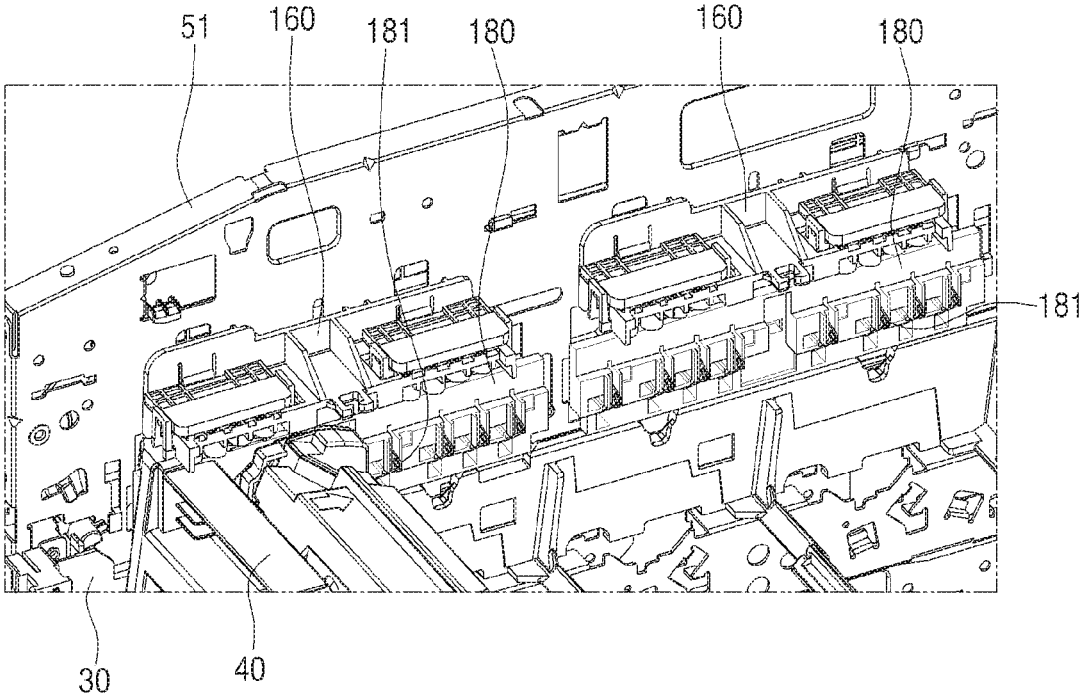
FIG. 18 is a perspective view illustrating an example that a high-voltage power supply unit is located in a first side frame according to an example.
Figure 19:
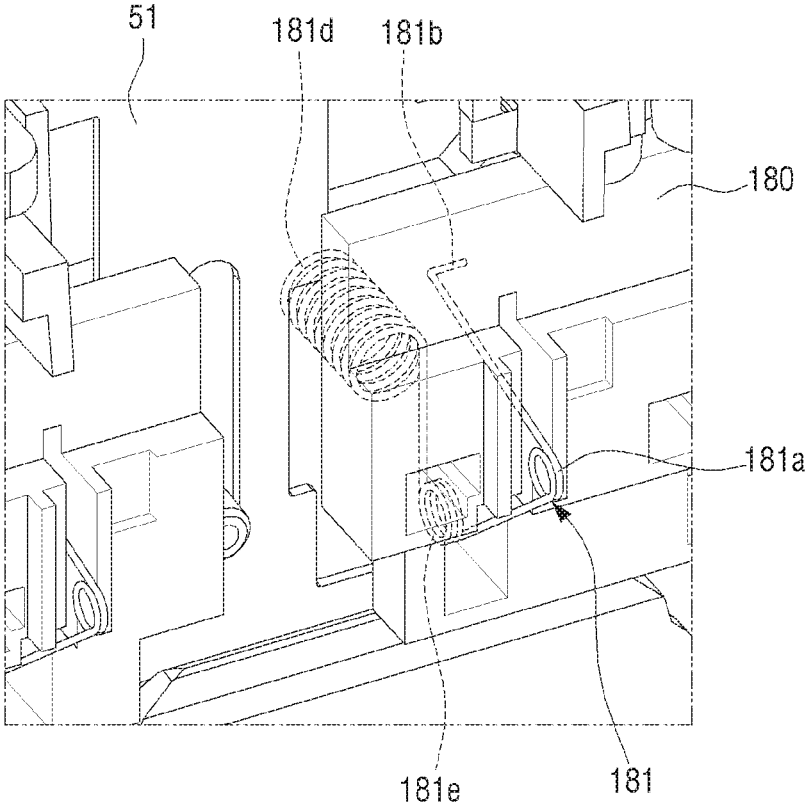
FIG. 19 is an enlarged view illustrating a terminal of the high-voltage power supply unit illustrated in FIG. 18.
Figure 20:
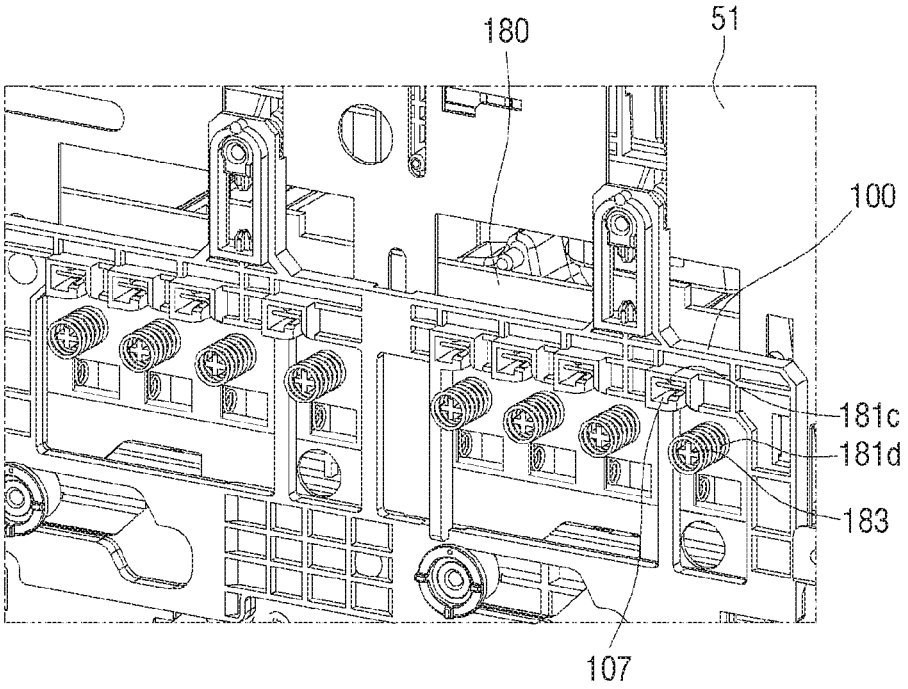
FIG. 20 is a diagram illustrating a terminal of a high-voltage power supply unit when viewed in an outer side of a first side frame according to an example.
Figure 21A:
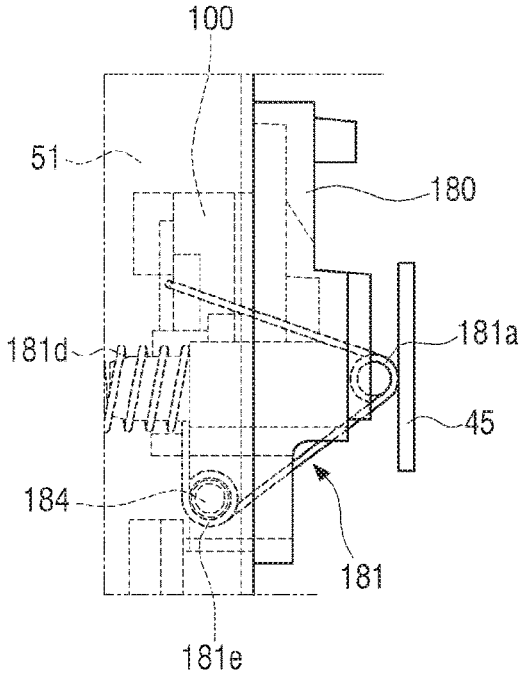
FIG. 21A and FIG. 21B illustrate examples that coupling/coupling release operations between a contact terminal of a high-voltage power supply unit and a high-voltage terminal of a toner cartridge according to an elevating operation of the high-voltage power supply unit according to an example.
Figure 21B:
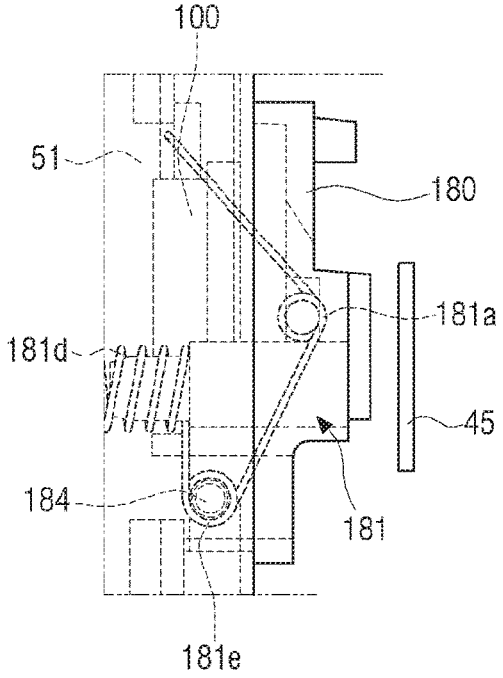

FIG. 18 is a perspective view illustrating an example that a high-voltage power supply unit is located in a first side frame according to an example and FIG. 19 is an enlarged view illustrating a terminal of the high-voltage power supply unit illustrated in FIG. 18. FIG. 20 is a diagram illustrating a terminal of a high-voltage power supply unit when viewed in an outer side of a first side frame according to an example and FIG. 21A and FIG. 21B illustrate examples that coupling/coupling release operations between a contact terminal of a high-voltage power supply unit and a high-voltage terminal of a toner cartridge according to an elevating operation of the high-voltage power supply unit according to an example.

The image forming apparatus 1 according to an example may include a plurality of devices which perform electrical operations. For example, the plurality of devices may include a device (not shown) configured to charge a surface of the photosensitive drum (see 46 of FIG. 22) provided in the toner cartridge 40, a device (not shown) configured to develop an electrostatic latent image formed on the surface of the photosensitive drum, and an image transfer belt unit (see 13 of FIG. 22) configured to transfer the developed electrostatic latent image onto a printing medium. Powers of the plurality of devices may be different voltage levels from each other, but all the powers may be DC high-voltage signals having a fixed voltage or more. However, an AC voltage provided to the image forming apparatus may be converted into a preset DC low-voltage signal and input to the image forming apparatus. Accordingly, the image forming apparatus may include a high-voltage power supply unit 180 configured to generate a plurality of high-voltage signals by receiving the low-voltage signal.

The high-voltage power supply unit 180 may be fixed to an inner surface of the first side frame 51. The high-voltage power supply unit 180 may include a substrate (not shown) in which a circuit configured to generate the plurality of high-voltage signals by receiving one low-voltage signal is formed and a plurality of contact terminals 181 electrically coupled to contacts (for example, a contact to which a high-voltage signal is applied and a grounded contact) in the substrate.

For example, contact terminals 181 of the high-voltage power supply unit 180 may be electrically coupled to a plurality of high-voltage terminals (see 45 of FIG. 3B) provided in the toner cartridge 40 in response to free end portions 181*a* protruding toward an outer side of the high-voltage power supply unit 180. In another example, in response to the free end portion 181*a* of each contact terminal 181 being pushed into an inner side of the high-voltage power supply unit 180, the electrical connection between the contact terminals 181 of the high-voltage power supply unit 180 and the plurality of high-voltage terminals 45 provided in the toner cartridge 40 may be released.

A first support end portion 181*b* of the contact terminal 181 may be fixed in the inside of the high-voltage power supply unit 180 as illustrated in FIG. 19 and a second support end portion 181*c* may be located in a fixing groove 107 of the support frame 100 as illustrated in FIG. 20. The contact terminal 181 may include an inner contact portion 181*d* electrically coupled to the substrate. The inner contact portion 181*d* may have substantially a coil shape as illustrated in FIG. 20 and may be coupled to a fixing protrusion 183 protruding from a portion of the high-voltage power supply unit 180. The contact terminal 181 may be pressurized to a direction that the first support end portion 181*b* of the contact terminal 181 is close to a third support end portion 181*e* so that the free end portion 181*a* protrudes toward an outer side of the high-voltage power supply unit 180 in a state that the support frame 100 descends. The third support end portion 181*e* may be fixed to a portion 184 of the high-voltage power supply unit 180.

Referring to FIG. 21A, the free end portion 181*a* of the contact terminal 181 may protrude toward the outer side of the high-voltage power supply unit 180 in a state that the support frame 100 descends. Accordingly, the free end portion 181*a* may be electrically coupled to the high-voltage terminal 45 of the toner cartridge 40.

In response to the support frame 100 being raised as illustrated in FIG. 21B, applied pressure applied to the first and third support end portions 181*b* and 181*e* of the contact terminal 181 may be released and the free end portion 181*a* of the contact terminal 181 may be pushed into the inner side of the high-voltage power supply unit 180 through elastic force. Accordingly, the electrical connection between the free end portion 181*a* of the contact terminal 181 and the high-voltage terminal 45 of the toner cartridge 40 may be released.

Hereinafter, a contact/separation operation between a photosensitive drum provided in the toner cartridge and an image transfer belt unit in tray elevation will be described with reference to FIGS. 22 and 23.

Figure 22:
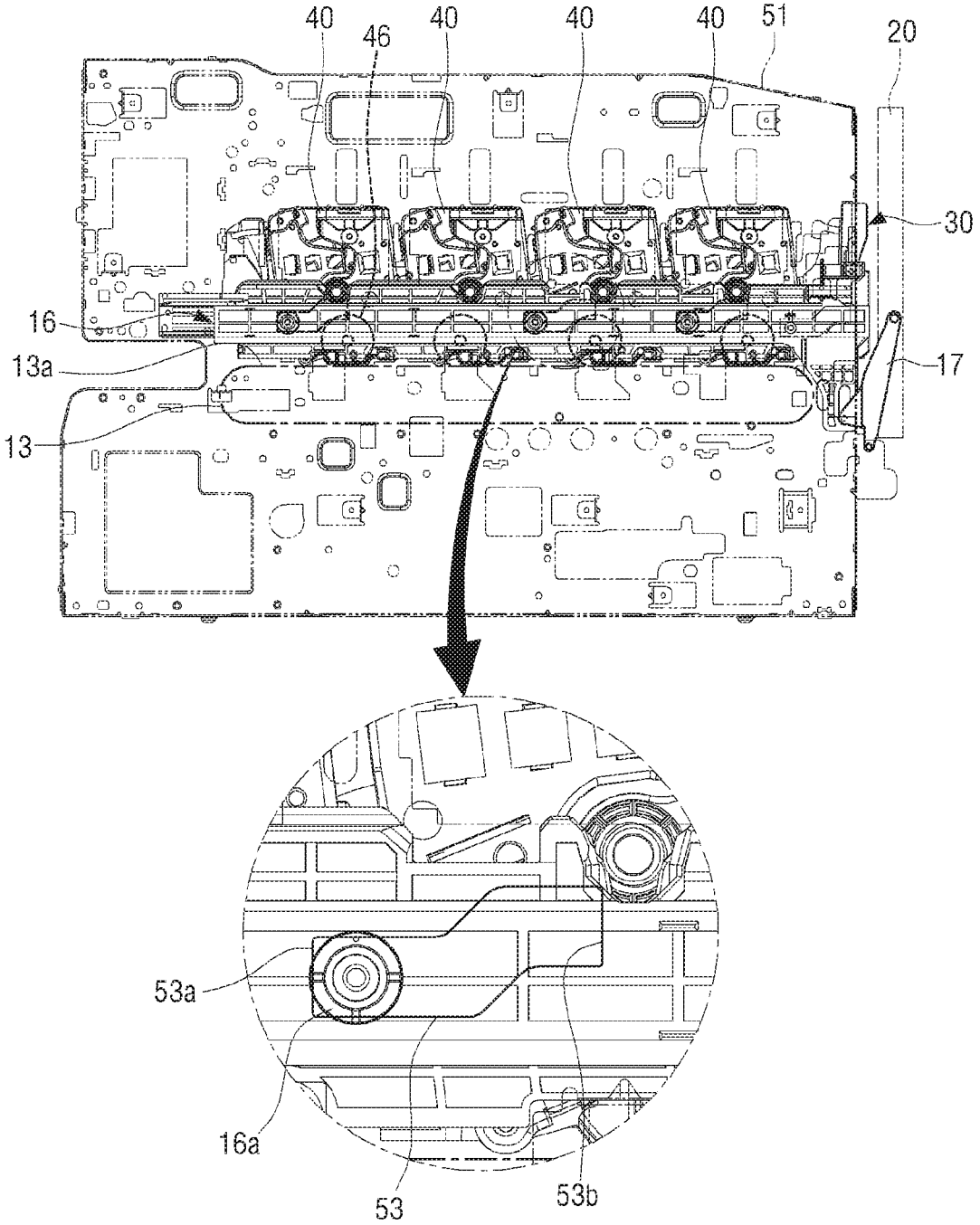
FIG. 22 is a diagram illustrating an example that a photosensitive drum of a toner cartridge is in contact with an image transfer belt unit in a state that a cover is closed according to an example.
Figure 23:
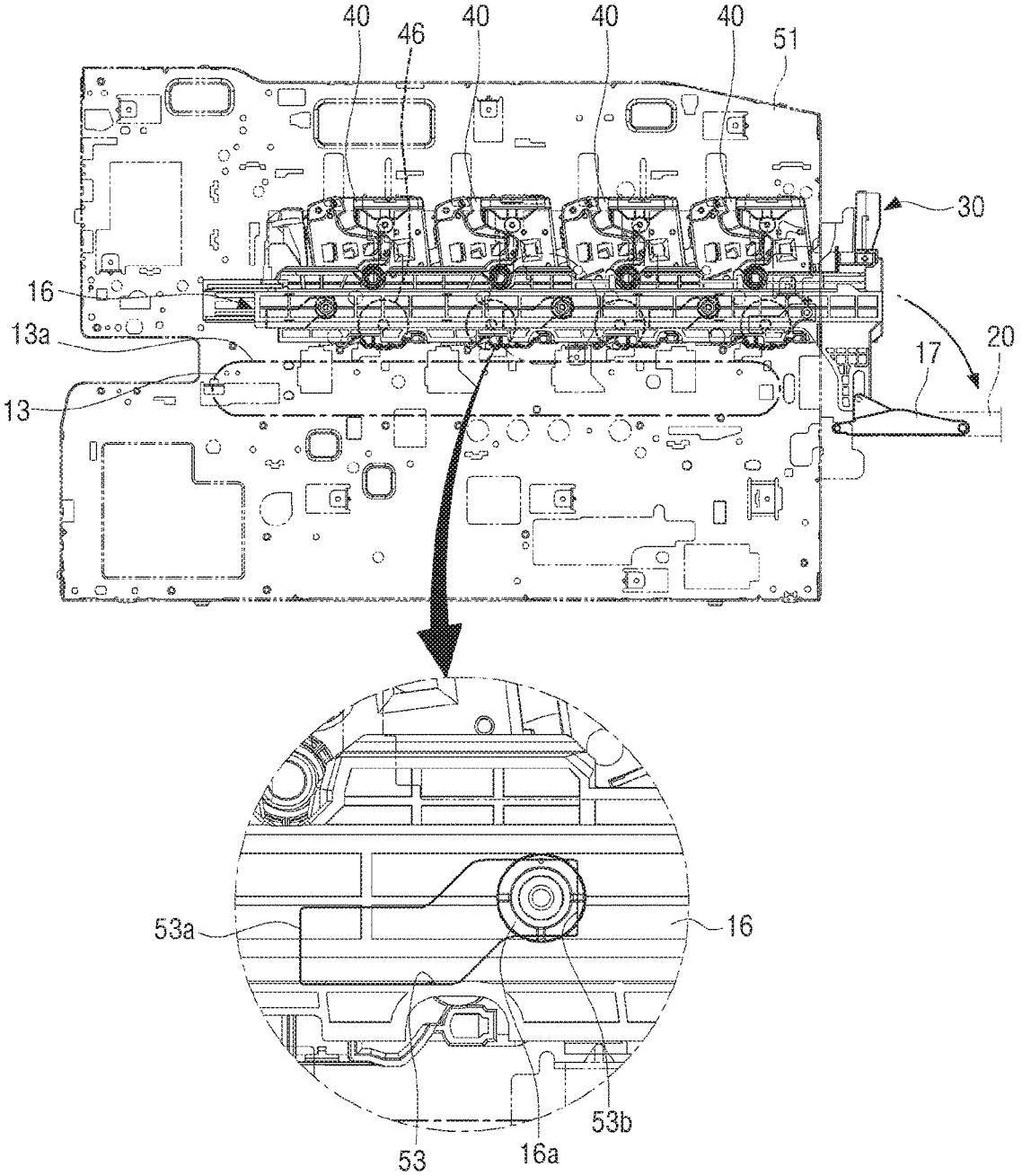
FIG. 23 is a diagram illustrating an example that a photosensitive drum of a toner cartridge is spaced from an image transfer belt unit in a state that a cover is opened according to an example.

FIG. 22 is a diagram illustrating an example that a photosensitive drum of a toner cartridge is in contact with an image transfer belt unit in a state that a cover is closed according to an example and FIG. 23 is a diagram illustrating an example that a photosensitive drum of a toner cartridge is separated from an image transfer belt unit in a state that a cover is opened according to an example.

Referring to FIG. 22, the plurality of rollers 16*a* of the guide rail 16 located in the inner side of the first side frame 51 may be located in the lift side 53*a* of the cam hole 53 of the first side frame 51 in a state that the cover 20 is closed.

For example, the photosensitive drum 46 of each of the toner cartridges 40 mounted on the tray 30 may be in contact with a surface of a belt 13*a* of the image transfer belt unit 13. The belt 13*a* of the image transfer belt unit 13 may rotate to a direction opposite to a rotation direction of the photosensitive drum 46 and simultaneously transfer a visible image onto paper.

In response to the cover 20 being opened as illustrated in FIG. 23 in a state that the cover 20 is closed, cover coupling levers 17 and 17' may rotate clockwise with the cover 20 and simultaneously move guide rails 16 and 16' disposed in the inner sides of the first and second side frames 51 and 55 to the tray pull-out direction by a fixed distance. The guide rail 16' disposed in the inner side of the second side frame 55 may be hinge-coupled to the cover coupling lever 17' to be interlocked to the cover coupling lever 17' as illustrated in FIG. 25.

For example, the plurality of rollers 16*a* of the guide rail 16 may move along the cam hole 53 of the first side frame 51 from the left side 53*a* of the cam hole 105 to the right side 53*b* thereof and thus the guide rails 16 and 16' may move to the tray pull-out direction and simultaneously may move upward by a fixed height h.

As the tray 30 placed in the guide rails 16 and 16' moves upward with the guide rails 16 and 16', the photosensitive drum 46 of each toner cartridge 40 may be spaced from a surface of the belt 13*a* of the image transfer belt unit 13. The tray 30 may be pulled out from the main body 10 along the tray pull-out direction in the spaced state.

A coupling/separation operation between a driving coupler and a photosensitive drum provided in a toner cartridge and one side of a developing roller will be described with reference to FIGS. 24 to 27.

Figure 24:
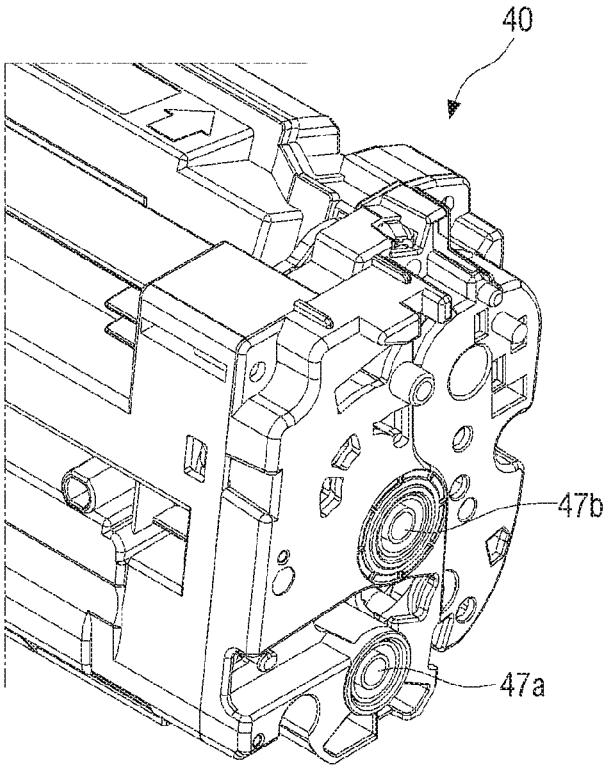
FIG. 24 is a diagram illustrating a rotation part of a photosensitive drum located in a side of a toner cartridge and a rotation part of a developing roller according to an example.
Figure 25A:
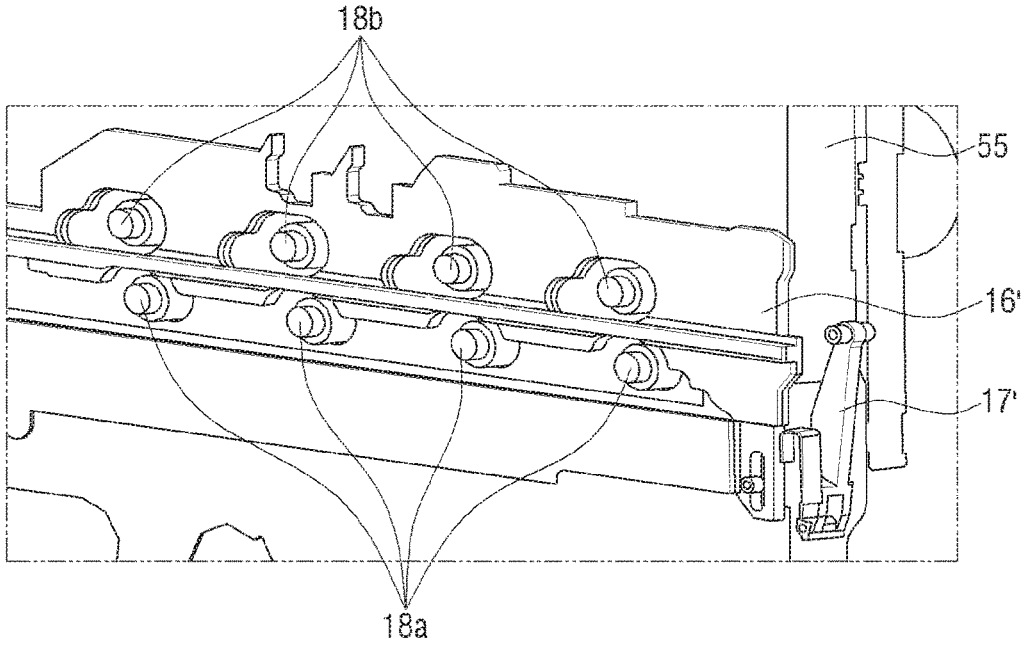
FIG. 25A and FIG. 25B illustrate examples that a plurality of driving couplers for transferring power to a rotation part of a photosensitive drum and a rotation part of a developing roller protrude and non-protrude from a second side frame according to an example.
Figure 25B:
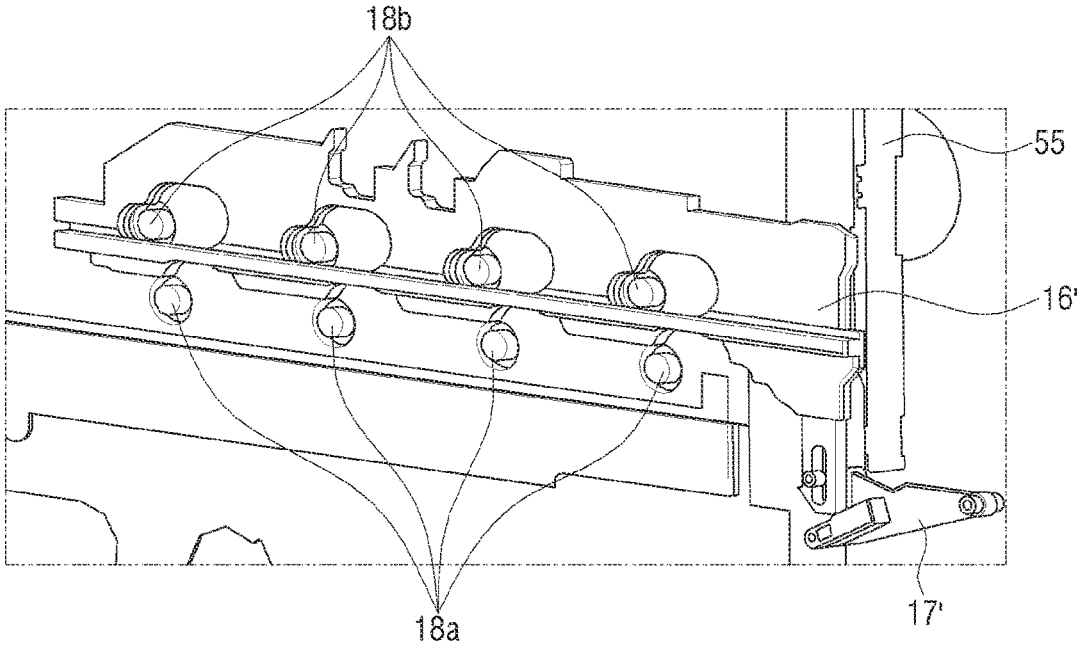

FIG. 24 is a diagram illustrating a photosensitive drum disposed in a side surface of a toner cartridge and a rotation part of a developing roller according to an example and FIG. 25A and FIG. 25B illustrate examples that a plurality of driving couplers for transferring power to a rotation part of a photosensitive drum and a rotation part of a developing roller protrude and non-protrude from a second side frame according to an example.

Referring to FIG. 24, the first coupling part 47*a* configured to rotate the photosensitive drum 46 and the second coupling part 47*b* configured to rotate a developing roller (not shown) may be disposed to be spaced from each other in the other side of the toner cartridge 40. The first coupling part 47*a* may be formed in one end of a rotation shaft of the photosensitive drum 46 and the second coupling part 47*b* may be formed in the other end of the developing roller.

Referring to FIG. 25A and FIG. 25B, a plurality of first driving couplers 18*a* and a plurality of second driving couplers 18*b* may be disposed in the second side frame 55. The first driving coupler 18*a* may be separately coupled to the first coupling part 47*a* of the toner cartridge 40 and may transfer rotation driving force to the first coupling part 47*a* to rotate the photosensitive drum 46 in response to the first driving coupler 18*a* being coupled to the first coupling part 47*a*. The second driving coupler 18*b* may be separately coupled to the second coupling part 47*b* of the toner cartridge 40 and may transfer rotation driving force to the second coupling part 47*b* to rotate the developing roller in response to the second driving coupler 18*b* being coupled to the second coupling part 47*b*.

For example, the plurality of first and second driving couplers 18*a* and 18*b* may be disposed in an outer side of the second side frame 55 and may protrude toward an inner side of the second side frame 55 in response to the first and second driving couplers 18*a* and 18*b* being coupled to the first and second coupling parts 47*a* and 47*b* of the toner cartridge 40. In another example, the plurality of first and second driving couplers 18*a* and 18*b* may move to the outer side of the second side frame 55 in response to the first and second driving couplers 18*a* and 18*b* being separated from the first and second coupling parts 47*a* and 47*b*.

Such an operation that the first and second driving couplers 18*a* and 18*b* protrudes toward the inner side of the second side frame 55 and move to the outer side of the second side frame 55 may be performed through a pressure frame 19 interlocked to the cover coupling lever 17'.

Figure 26:
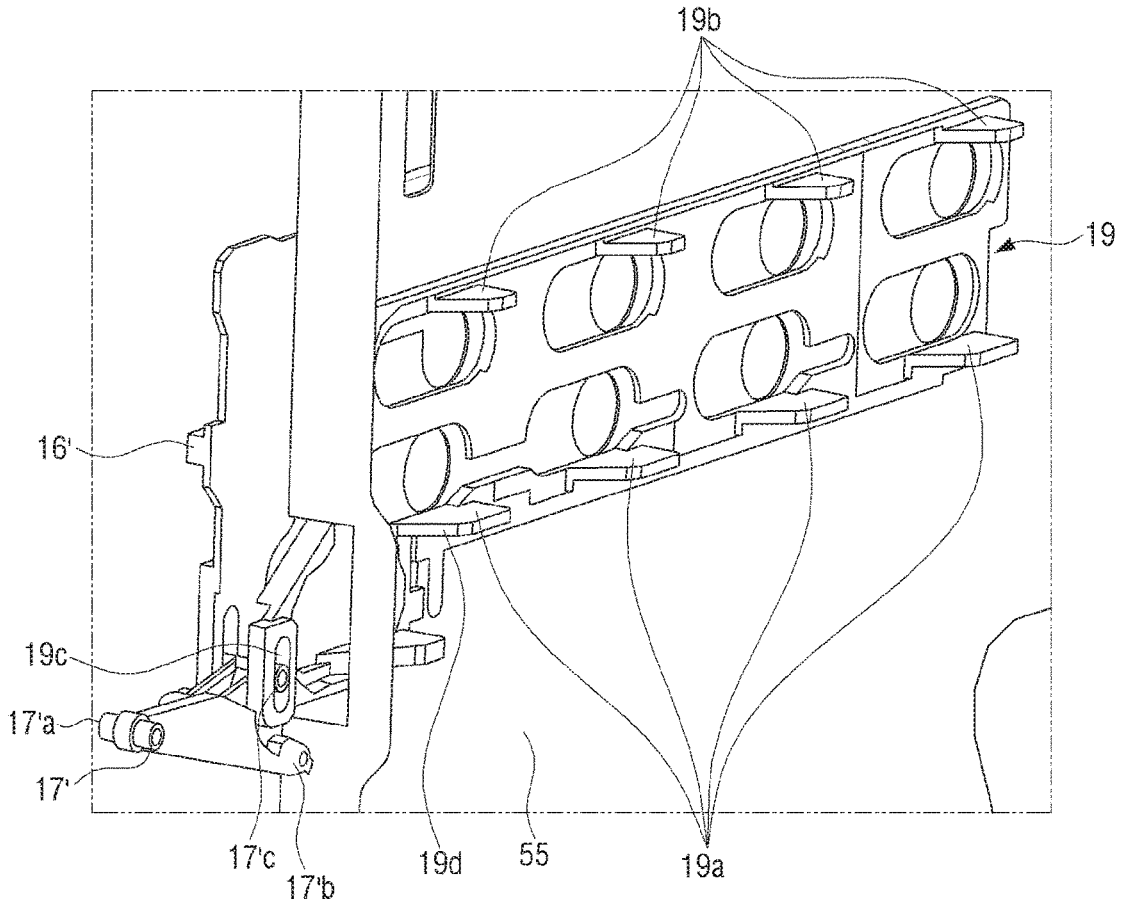
FIG. 26 is a diagram illustrating a pressure frame for protruding or non-protruding a plurality of driving couplers according to an example.

FIG. 26 is a diagram illustrating a pressure frame for protruding or non-protruding a plurality of driving couplers according to an example.

Referring to FIG. 26, the pressure frame 19 may be slidably movably disposed in the inner side of the second side frame 55 to the tray push-in/pull-out direction. An elongated hole 19*c* formed in one end portion of the pressure frame 19 may be hinge-coupled to an extension portion 17'*c* of the cover coupling lever 17'. For example, the pressure frame 19 may linearly move to the tray pull-out direction according to the clockwise rotation of the cover coupling lever 17' and may linearly move to the tray push-in direction according to counterclockwise rotation of the cover coupling lever 17'. In this example, an upper end portion 17'*a* of the cover coupling lever 17' may be hinge-coupled to the cover 20 and a lower end portion 17'*b* thereof may be hinge-coupled to a portion of the first side frame 51.

A plurality of first pressure protrusions 19*a* may be formed in one-side surface of the pressure frame 19 to protrude and a plurality of second pressure protrusions 19*b* may be formed over the plurality of first pressure protrusions 19*a* to protrude. The first and second pressure protrusions 19*a* and 19*b* may perform pressure and pressure release on the first and second driving couplers 18*a* and 18*b* in response to the pressure frame 19 being moved to the tray push-in/pull-out direction. Accordingly, the first and second driving couplers 18*a* and 18*b* may selectively protrude toward the inner side of the second side frame 55 as illustrated in FIG. 25A and may move to the outer side of the second side frame 55 to maintain a non-protruding state as illustrated in FIG. 25B.

Figure 27:
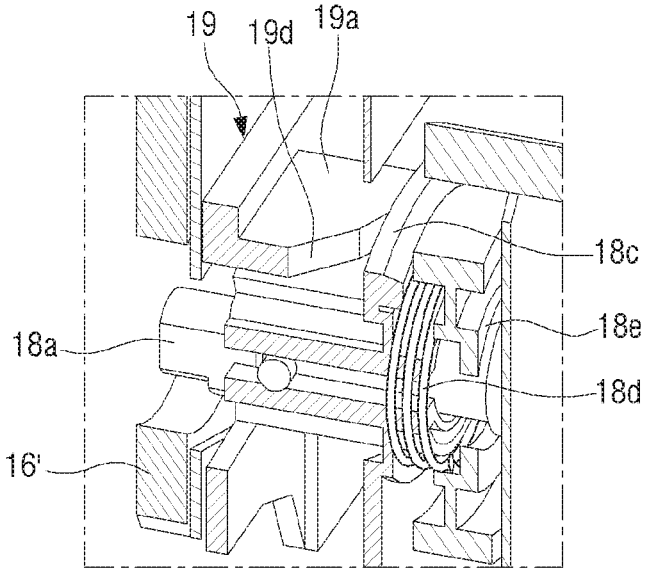
FIG. 27 is a diagram illustrating an example that a driving coupler is maintained in a non-protruding state according to a movement of a pressure frame to a tray push-in direction according to an example.

FIG. 27 is a diagram illustrating an example that a driving coupler is maintained in a non-protruding state according to a movement of a pressure frame to a tray push-in direction according to an example.

Referring to FIG. 27, a rear-end portion 18*c* of the first driving coupler 18*a* may be elastically supported to a direction that the rear-end portion 18*c* protrudes toward the inner side of the second side frame 55 through a compression spring 18*d*. For example, one end of the compression spring 18*d* may be fixed to the rear-end portion 18*c* of the first driving coupler 18*a* and the other end of thereof may be fixed to a structure 18*e* disposed to be spaced from the rear-end portion 18*c* of the first driving coupler 18*a*.

For example, the cover coupling lever 17' may rotate clockwise and the pressure frame 19 may move to the tray pull-out direction in conjunction with the clockwise rotation of the cover coupling lever 17'. The rear-end portion 18*c* of the first driving coupler 18*a* may be pushed through the first pressure protrusion 19*a* of the pressure frame 19 and may move toward the outer side of the second side frame 55. In this example, the rear-end portion 18*c* of the first driving coupler 18*a* may be in slidable contact with a sliding surface 19*d* of the pressure protrusion 19*a*. Accordingly, the first driving coupler 18*a* may maintain the non-protruding state in a state that the first driving coupler 18*a* is elastically supported through the compression spring 18*d* and the coupling of the first driving coupler 18*a* to the first coupling part 47*a* of the toner cartridge 40 may be released.

In another example, the cover coupling lever 17' may rotate counterclockwise and the pressure frame 19 may move to the tray push-in direction in conjunction with the counterclockwise rotation of the cover coupling lever 17'. The pressure of the rear-end portion 18*c* of the first driving coupler 18*a* through the first pressure protrusion 19*a* of the pressure frame 19 may be released. Accordingly, the first driving coupler 18*a* may protrude toward the inner side of the second side frame 55 through the compression spring 18*d* and may be coupled to the first coupling part 47*a*.

Although not shown in FIG. 27, the protruding operation and the non-protruding operation of the second driving coupler 18*b* from the second side frame 55 may be performed through the same structure as the above-described structure for performing the protruding operation and the non-protruding operation of the first driving coupler 18*a* and thus detailed description thereof will be omitted.

It has been described in the above-described example that the contact and separation operations between the image transfer belt unit 13 and the photosensitive drum are performed through the opening/closing of the cover 20, but this is not limited thereto. The contact and separation operations between the image transfer belt unit and the photosensitive drum may be performed in conjunction with a rotation operation of the handle provided in the tray. The contact and separation operations in conjunction with a rotation operation of the handle will be described with reference to FIG. 28.

Figure 28:
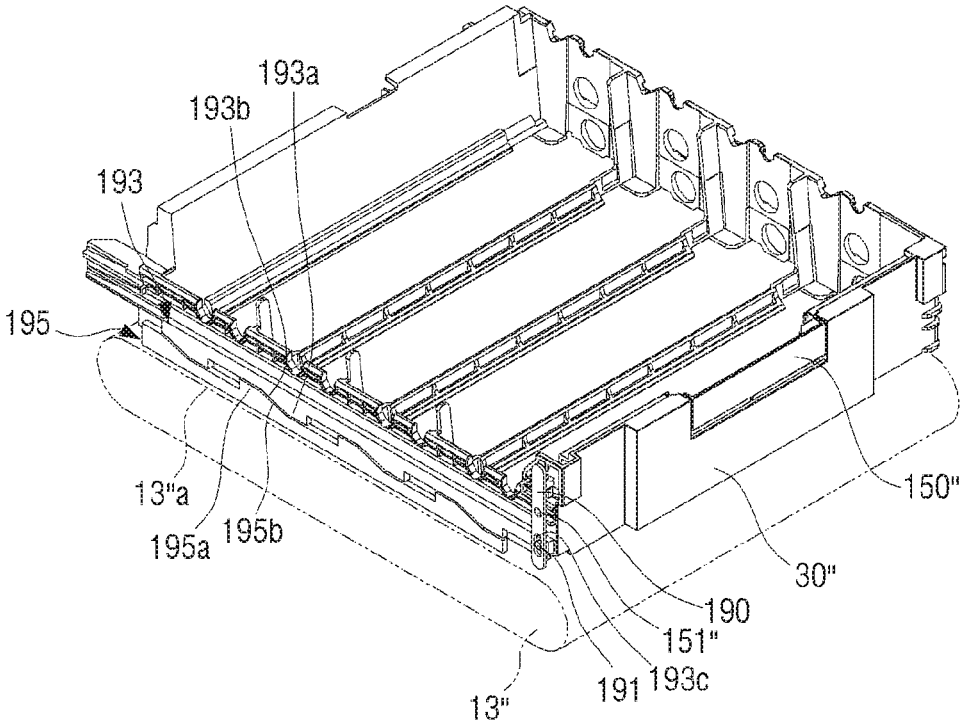
FIGS. 28 and 29 are diagrams illustrating examples that a photosensitive drum is in contact with an image transfer belt unit and is spaced from the image transfer belt unit according to a clockwise/counterclockwise rotation of a handle provided in a tray according to an example.
Figure 29:
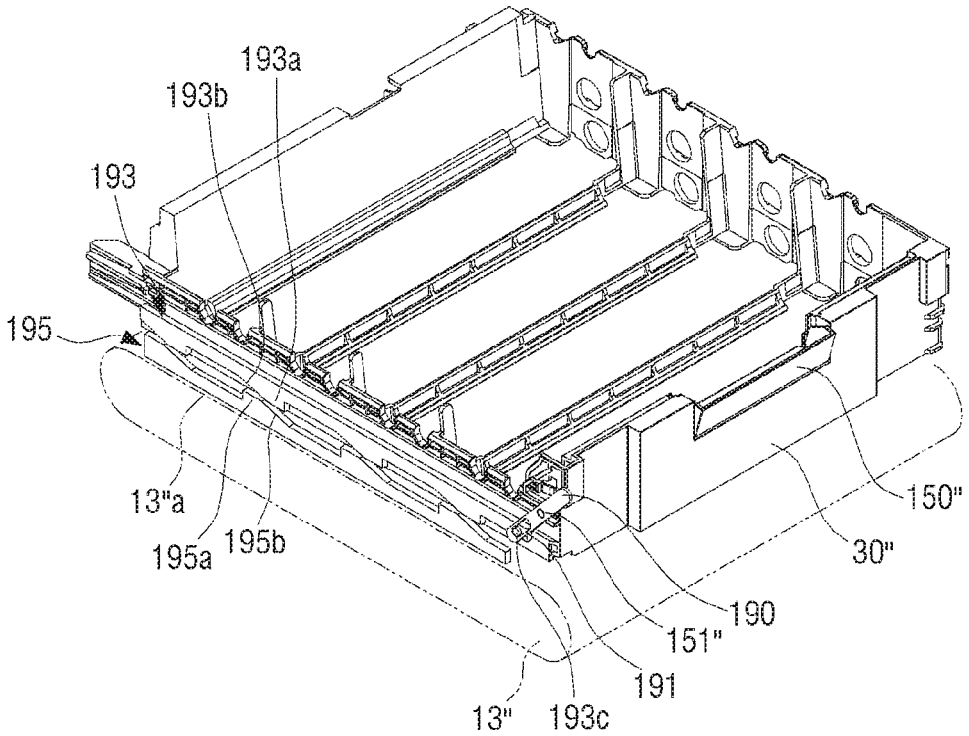

FIGS. 28 and 29 are diagrams illustrating examples that a photosensitive drum is in contact with an image transfer belt unit and is spaced from the image transfer belt unit according to a clockwise/counterclockwise rotation of a handle provided in a tray according to an example.

Referring to FIG. 28, a movable lever 190 rotatably coupled to one side of a tray 30" may be provided in one side of the tray 30". The movable lever 190 may be coupled to a rotation shaft 151" of a handle 150" and may rotate clockwise and counterclockwise with the handle 150".

Movable guide members 193 may be disposed along both-side lower ends of the tray 30". The movable guide members 193 may slidably move along the lower ends of the tray 30" to the tray push-in direction in clockwise rotation of the movable lever 190 and may move to the tray pull-out direction in counterclockwise rotation of the movable lever 190. For example, a coupling protrusion 193*c* which is slidably movably coupled to an elongated hole 191 formed in the movable lever 190 may be formed in the movable guide member 193.

A plurality of first guide protrusions 193*a* may be formed at intervals along a lower end of the movable guide member 193 to protrude downward. A first inclined portion 193*b* corresponding to a second inclined portion 195*b* to be described later may be formed in each of the plurality of first guide protrusions 193*a*.

A pair of fixed guide members 195 corresponding to a pair of movable guide members 193 may be disposed in both sides of the image transfer belt unit 13". The pair of fixed guide members 195 may be fixed to the image transfer belt unit 13".

A plurality of second guide protrusions 195*a* may be formed at intervals along an upper end of the fixed guide member 195 to protrude downward. The second inclined portion 195*b* may be formed in each of the plurality of second guide protrusions 195*a*. The second inclined portion 195*b* of the second guide protrusion 195*a* may be corresponding to the first inclined portion 193*b* of the first guide protrusion 193*a* and may be in slidable contact with the first inclined portion 193*b* in response to the movable guide member 193 being moved to the tray push-in/pull-out direction.

The photosensitive drum of the toner cartridge mounted on the tray 30" may be in contact with a belt 13"*a* of the image transfer belt unit 13" in a state that the tray 30" is pushed into the main body 10 as illustrated in FIG. 28. For example, the first and second inclined portions 193*b* and 195*b* of the first and second guide protrusions 193*a* and 195*a* may be in contact with each other in a facing state.

In this example, as illustrated in FIG. 29, the movable lever 190 may rotate clockwise with the handle 150" in response to the handle 150" being rotated clockwise. The movable guide member 193 may move to the tray push-in direction through the rotation of the movable lever 190.

As the first guide protrusion 193*a* moves with the movable guide member 193, the first inclined portion 193*b* of the first guide protrusion 193*a* may slidably move along the second inclined portion 195*b* of the second guide protrusion 195*a*. Accordingly, the tray 30" may rise to a fixed height and the photosensitive drum of the toner cartridge may be spaced from the belt 13"*a* of the image transfer belt unit 13".

The handle 150" may rotate counterclockwise and the movable lever 190 may also rotate counterclockwise with the handle 150". Accordingly, the tray 30" may descend to a fixed height and the photosensitive drum of the toner cartridge may be in contact with the belt 13"*a* of the image transfer belt unit 13".

In the examples, at least one of operations performed in conjunction with an opening/close operation of a cover may be interlocked to a tray push-in/pull-out operation or to an operation of a handle provided in the tray. Accordingly, the force concentrated in the cover opening/closing operation may be dispersed and thus the cover opening/closing operation may be easily performed without large force and the large force concentrated on the cover may be prevented. Accordingly, the endurance of the cover may be guaranteed.

The foregoing examples and advantages are merely examples and are not to be construed as limiting the disclosure. The teachings can be readily applied to other types of apparatuses. Also, the description of the examples of the disclosure is intended to be illustrative, and not to limit the scope of the claims, and many alternatives, modifications, and variations will be apparent to those skilled in the art.

What is claimed is:

1. An image forming apparatus, comprising:

a main body;

a tray, slidably coupled to the main body, to receive a toner cartridge;

a lever, hinge-coupled to the tray, to rotate in a first direction when the tray is pushed into the main body and to rotate in a second direction opposite to the first direction when the tray is pulled out from the main body; and a link member, hinge-coupled to the lever, to move in a third direction when the lever is rotated in the first direction so that pressure is applied to a customer replacement unit memory (CRUM) contact unit and to move in a fourth direction opposite to the third direction when the lever is rotated in the second direction so that the pressure is released from the CRUM contact unit.

2. The image forming apparatus as claimed in claim 1, wherein the tray includes a push rib to apply pressure to a first portion of the lever when the tray is pushed into the main body.

3. The image forming apparatus as claimed in claim 2, wherein the tray further includes an auxiliary push rib to apply pressure to the first portion of the lever when the tray is pulled out of the main body, and the auxiliary push rib is spaced apart from the push rib and is located closer to the CRUM contact unit than the push rib.

4. The image forming apparatus as claimed in claim 3, wherein the auxiliary push rib has an upper end height smaller than that of the push rib so that an upper end of the auxiliary push rib remains clear of the tray when the tray is pushed into the main body.

5. The image forming apparatus as claimed in claim 1, wherein the main body further includes a first side frame, and the lever is hinge-coupled to the first side frame and is elastically coupled to the first side frame through an elastic member.

6. The image forming apparatus as claimed in claim 5, wherein a first end of the elastic member is fixed to the lever and a second end of the elastic member is fixed to the first side frame to apply an elastic force to the lever.

7. The image forming apparatus as claimed in claim 5, wherein the elastic member is located in the lever.

8. The image forming apparatus as claimed in claim 1, wherein the link member includes at least one cam protrusion to apply pressure to at least one guide protrusion which protrudes from the CRUM contact unit, and the cam protrusion includes an inclined cam end portion which is in contact with the at least one guide protrusion.

9. The image forming apparatus as claimed in claim 1, further comprising:

a handle rotatably coupled to the tray; and a latch in which the tray is to move along an inner side thereof according to a rotation of the handle, and including a front-end that selectively protrudes toward an outside of the tray.

10. The image forming apparatus as claimed in claim 9, wherein the front-end of the latch protrudes such that the lever contacts the front-end.

11. The image forming apparatus as claimed in claim 9, wherein the handle is in contact with the latch, and the front-end of the latch protrudes toward an outer side of the tray in response to the handle being rotated in a first handle rotation direction and moves toward an inner side of the tray in response to the handle being rotated in a second handle rotation direction.

12. The image forming apparatus as claimed in claim 9, wherein the latch is elastically supported in a protruding direction of the latch by an elastic member.

13. The image forming apparatus as claimed in claim 1, further comprising:

an image transfer unit;

a handle rotatably coupled to the tray;

a movable lever, located in a side of the tray, to rotate with the handle;

a first guide member to move according to the rotation of the movable lever; and a second guide member fixed to the image transfer unit, wherein the tray is selectively raised according to the movement of the first guide member.

14. The image forming apparatus as claimed in claim 13, wherein the first guide member is located to slidably move along a lower end of the tray.

15. The image forming apparatus as claimed in claim 13, wherein the first guide member includes a first guide protrusion, the second guide member includes a second guide protrusion, and the first guide protrusion and the second guide protrusion are in contact with each other.

16. The image forming apparatus as claimed in claim 1, further comprising a support frame to elastically support the CRUM contact unit.

17. An image forming apparatus, comprising:

a main body;

a tray, slidably coupled to the main body, to receive a toner cartridge; and an interlocking unit to apply a force to a customer replacement unit memory (CRUM) contact unit when the tray is pushed into the main body to thereby cause the CRUM contact unit to descend and be electrically coupled to the toner cartridge, and to release the force applied to the CRUM contact unit when the tray is pulled out from the main body such that the CRUM contact unit is electrically decoupled from the toner cartridge.

18. The image forming apparatus as claimed in claim 17, wherein when the tray is pushed into the main body to thereby cause the CRUM contact unit to descend and be electrically coupled to the toner cartridge, at least one terminal of the CRUM contact unit is directly coupled to at least one terminal of the toner cartridge.

19. An image forming apparatus, comprising:

a main body;

a tray, slidably coupled to the main body, to receive a toner cartridge; and an interlocking unit, including:

a lever, coupled to the tray, to rotate in a first direction when the tray is pushed into the main body and to rotate in a second direction when the tray is pulled out from the main body, and a link member, coupled to the lever, to move when the lever is rotated in the first direction such that a customer replacement unit memory (CRUM) contact unit is lowered to be electrically coupled to the toner cartridge, and to move when the lever is rotated in the second direction such that the CRUM contact unit is raised by an elastic force to release the electrical coupling to the toner cartridge.

20. The image forming apparatus as claimed in claim 19, wherein the link member moves in a linear direction.

* * * * *